US005969736A

United States Patent [19]

Field et al.

[11] Patent Number: 5,969,736

[45] Date of Patent: Oct. 19, 1999

[54] PASSIVE PRESSURE REGULATOR FOR SETTING THE PRESSURE OF A LIQUID TO A PREDETERMINED PRESSURE DIFFERENTIAL BELOW A REFERENCE PRESSURE

[75] Inventors: Leslie A. Field; Phillip Barth, both of Portola Valley, Calif.; David J. Waller, Corvallis, Oreg.; George D. Zuras, Jr., San Jose, Calif.; Paul P. Merchant, Belmont, Calif.; Storrs Hoen, Brisbane, Calif.; Channing R. Robertson, Stanford, Calif.

[73] Assignee: Hewlett-Packard Company, Palo Alto, Calif.

[21] Appl. No.: 09/116,427

[22] Filed: Jul. 14, 1998

[51] Int. Cl.[6] ..... B41J 2/175

[52] U.S. Cl. ..... 347/85

[58] Field of Search ..... 347/85, 86, 87, 347/94; 138/26, 30

[56] References Cited

U.S. PATENT DOCUMENTS

| | | | |
|---|---|---|---|
| 4,347,524 | 8/1982 | Engel et al. | 347/94 |
| 4,535,343 | 8/1985 | Wright et al. | 347/64 |
| 4,550,326 | 10/1985 | Allen et al. | 347/44 |
| 5,058,856 | 10/1991 | Gordon et al. | 251/11 |
| 5,300,959 | 4/1994 | McClelland et al. | 347/47 |
| 5,350,616 | 9/1994 | Pan et al. | 428/131 |
| 5,635,968 | 6/1997 | Bhaskar et al. | 347/59 |

OTHER PUBLICATIONS

Thomas K. Jun and Chang–Jin Kim, "Microscale Pumping with Transversing Bubbles in Microchannels", Solid State Sensor and Actuator Workshop, Hilton Head, South Carolina, Jun. 2–6, 1996, pp. 144–147.

*Primary Examiner*—N. Le
*Assistant Examiner*—Michael Nghiem
*Attorney, Agent, or Firm*—Ian Hardcastle

[57] ABSTRACT

A pressure regulator that sets the pressure of a liquid to a predetermined pressure differential below a reference pressure, such as atmospheric pressure. The pressure regulator comprises a liquid delivery channel and a capillary array. The liquid delivery channel includes a liquid input and a liquid output. The liquid flows through the liquid delivery channel from the liquid input to the liquid output. The capillary array is composed of ones of an elongate capillary. The capillary includes a first end in fluid communication with the liquid delivery channel and a second end in pressure communication with a source of the reference pressure. The liquid flows through the first end into the capillary to form a liquid surface in the capillary. The second end is remote from the first end. The capillary has cross-sectional dimensions in relation to the surface tension of the liquid and the angle of contact between the liquid and the capillary such that the pressure drop across the liquid surface in the capillary is equal to the predetermined pressure differential.

31 Claims, 8 Drawing Sheets

PASSIVE PRESSURE REGULATOR FOR SETTING THE PRESSURE OF A LIQUID TO A PREDETERMINED PRESSURE DIFFERENTIAL BELOW A REFERENCE PRESSURE

FIELD OF THE INVENTION

The invention relates to pressure regulators for liquids, and more particularly, to a method and apparatus for controlling the pressure at which ink is delivered to the firing chamber in the print head of an inkjet printer.

BACKGROUND OF THE INVENTION

As the number of homes and businesses that acquire computer equipment grows, the need for reliable, fast and cost-effective printers also continues to grow. In recent years, the print quality of inkjet printers has improved greatly to the extent that it now rivals that of laser printers.

The print head of an inkjet printer forms part of a print cartridge that is mounted in a carriage that moves the print cartridge back and forth across the paper. The print head includes many orifices, typically arranged in line aligned parallel to the direction in which the paper is moved through the printer and perpendicular to the direction of motion of the print head. Each orifice constitutes the outlet of a firing chamber in which is located a firing element such as a heating element or piezoelectric element. The firing element operates in response to an electrical signal to cause minute droplets of ink to be ejected from the orifice. Ink from a reservoir is supplied to the firing chambers through an ink manifold in the print head. When printing, a page is fed through the printer while the carriage moves the print cartridge, including the print head, back and forth across the page, to enable the print head to deliver ink to the paper. The rapid motion of the print cartridge during printing, variations in ink viscosity, temperature and altitude all contribute to difficulties in regulating the pressure at which the ink is delivered to each firing chamber in the print head.

In a so-called "on axis" arrangement, the print cartridge of an inkjet printer typically includes an ink reservoir located behind the print head. In newer inkjet printers that have an "off axis" arrangement, only a small amount of ink is stored in the print cartridge, and the main ink reservoir is positioned at a location remote from the print head. In the off-axis arrangement, an ink delivery tube delivers ink from the remote reservoir to the print cartridge. The ink delivery tube is considerably longer than the length of the ink delivery path in a typical on-axis print head. The off-axis arrangement reduces the mass of the print cartridge, which enables the print speed to be increased, or the power consumption of the carriage scanning mechanism to be reduced. The off-axis arrangement additionally provides the option of an increased ink storage capacity. However, the off-axis arrangement requires a pump or a gravity feed arrangement to deliver the ink through the ink delivery tube, and movement of the print cartridge causes the ink delivery tube to flex. Both of these factors compound the above-discussed difficulties in regulating the pressure at which ink is delivered to the print head.

In both on-axis and off-axis configurations, maintaining a predetermined ink pressure at the firing chamber is critical to the orifice delivering the expected amount of ink to the paper when the firing element operates. While some ink pressure regulation methods and devices regulate the ink pressure to a given absolute pressure, better ink pressure regulation methods and devices regulate the pressure of the ink in the firing chamber to a predetermined pressure below atmospheric pressure, since an ink pressure in the firing chamber equal to or greater than atmospheric pressure will cause ink to leak from the orifice. Therefore, the ink pressure in the firing chamber should be maintained at below atmospheric pressure to prevent the ink from leaking. On the other hand, too large a difference between the ink pressure in the firing chamber and atmospheric pressure will result in insufficient ink being delivered to the paper during printing. Accordingly, the difference between the ink pressure in the firing chamber and atmospheric pressure should be maintained within a predetermined range.

Spring-bag ink reservoir devices are widely used to regulate the ink pressure in the firing chambers of inkjet printers. In a spring-bag device, as the bag empties, the spring keeps ink stored in the bag at a constant pressure. This keeps the ink delivered to the firing chamber at a constant pressure. Additional measures are required to keep the difference between the ink pressure in the firing chamber and atmospheric pressure within a predetermined range.

U.S. Pat. No. 4,771,295 to Baker and assigned to the assignee of the present disclosure describes using a reticulated polyurethane foam placed in the ink reservoir to control ink pressure. Such an arrangement reduces the volume of ink that can be stored in a reservoir of a given size, however. Moreover, the regulated ink pressure varies due to variations in the size of the pores in the foam.

U.S. Pat. No. 4,794,409 to Cowger et al. and assigned to the assignee of the present disclosure describes an ink jet print head composed of a primary ink reservoir, a secondary reservoir and an orifice all interconnected by a porous member such as foam. As the pressure in the primary ink reservoir changes relative to ambient pressure, ink is drawn through the foam back and forth between the primary and secondary reservoirs.

U.S. Pat. No. 4,791,438 to Hanson et al. describes an inkjet print head having a primary ink reservoir, a secondary reservoir and a capillary member interconnecting the reservoirs. As the pressure in the primary ink reservoir changes relative to ambient pressure, ink is drawn through the capillary back and forth between the primary and secondary reservoirs.

U.S. Pat. No. 5,010,354 of Cowger et al., assigned to the assignee of the present disclosure, and entitled Ink Jet with Improved Volumetric Efficiency, describes a device in which a chamber containing a capillary volume element is directly coupled to an ink reservoir. Pressure in the ink reservoir is defined by a bubble generator coupled to the ink reservoir. A portion of the ink reservoir remote from the chamber is coupled to the print head. Pressure in the capillary volume element is greater than the normal sub-atmospheric pressure in the ink reservoir, but is less than atmospheric pressure. During operation at ambient pressures and temperatures within a normal range, ink does not enter the capillary volume element. When subject to temperatures and pressures outside the normal range, an increased pressure in the reservoir forces ink into the capillary volume element. This limits the pressure increase in the ink reservoir and prevents ink from being ejected from the print head. As the pressure in the ink reservoir returns to the normal range, the ink reservoir draws ink from the capillary volume element. In this arrangement, the capillary element acts a pressure surge protector for the ink reservoir. Since the capillary volume element controls the pressure in the ink reservoir, its volume must be of the same order as that of the ink reservoir. Thus, this arrangement suffers from the drawbacks that the mass of the capillary volume element increases the total mass of the print head, and the capillary volume element is complex to manufacture.

What is needed is an ink pressure regulator which can reliably maintain the pressure of the ink delivered to the firing chamber at a predetermined differential below atmospheric pressure or some other reference pressure. What is also needed is an ink pressure regulator that primarily provides such ink pressure regulation passively and that does not significantly increase the mass of the print head.

SUMMARY OF THE INVENTION

The invention provides a pressure regulator for setting the pressure of a liquid to a predetermined pressure differential below a reference pressure, such as atmospheric pressure. The pressure regulator comprises a liquid delivery channel and a capillary array. The liquid delivery channel includes a liquid input and a liquid output. The liquid flows through the liquid delivery channel from the liquid input to the liquid output. The capillary array is composed of substantially similar ones of an elongate capillary in a substantially planar arrangement. The capillary includes a first end in fluid communication with the liquid delivery channel and a second end in pressure communication with a source of the reference pressure. The liquid flows through the first end into the capillary to form a liquid surface in the capillary. The second end is remote from the first end. The capillary has cross-sectional dimensions in relation to the surface tension of the liquid and the contact angle between the liquid and the capillary such that the pressure drop across the liquid surface in the capillary is equal to the predetermined pressure differential.

The pressure regulator may additionally comprise a flow restrictor located in the liquid delivery channel upstream of the capillary array. The flow restrictor may be one or more valves. The one or more valves may be controlled by a sensor.

The sensor may detect the pressure in the ink delivery channels and may include a pressure sensor capillary. Alternatively, the sensor may detect whether or not the capillary is filled with ink.

The pressure sensor is preferably formed on a substrate, which may be a single-crystal semiconductor material such as silicon. Preferably, a barrier layer is located on a major surface of the substrate and the ink delivery channel is defined in the barrier layer. The capillary array may extend from the ink delivery channel through the thickness of the substrate. Additionally or alternatively, the capillary array may be formed in the barrier layer with the capillaries extending parallel to the major surface of the substrate. When the capillaries are formed in the barrier layer, they may be given a rounded cross-section by forming fillets between the barrier layer and the substrate, and the barrier layer and the plate covering the ink delivery channel.

The ink delivery channel may extend radially outwards from the ink inlet to the ink outlet, and the capillary array may be substantially co-extensive with the ink delivery channel. The pressure regulator may additionally comprise an electrically-operated valve that closes and opens the ink inlet to control the flow of ink to the capillary array.

DETAILED DESCRIPTION OF THE INVENTION

As described above, the pressure at which ink is delivered to the firing chambers in the print head of an inkjet printer should be regulated to a predetermined pressure differential below atmospheric pressure. This is to ensure that the firing elements eject the expected quantity of ink from the orifices of the firing chambers during printing and to prevent ink from leaking from the orifices when printing is not being performed. If the differential pressure at which ink is delivered to the print head is too high, i.e., the absolute pressure of the ink is too low, then less than the expected amount of ink will be ejected from the orifices. If the differential pressure at which ink is delivered to the print head is too low, i.e., the absolute pressure of the ink is too high, then the firing elements will eject more than the appropriate amount of ink from the orifices, and ink could be expelled from the orifices without the firing elements operating.

The invention provides a substantially passive pressure regulator that maintains the pressure at which ink is delivered to the print head at a predetermined differential below atmospheric pressure. The pressure regulator enables the expected quantity of ink to be ejected from the orifices during printing and prevents ink from leaking from the orifices. The pressure regulator is cost-efficient and can be manufactured in a way that allows design changes to be incorporated quickly and at relatively low cost. The pressure regulator may also be incorporated in other devices in which the pressure of a liquid is to be regulated to a predetermined differential below a reference pressure.

Embodiments of a pressure regulator according to the invention will now be described with reference to an example in which the pressure regulator regulates the pressure at which ink is delivered to the print head of an ink jet printer.

Figure 1A:
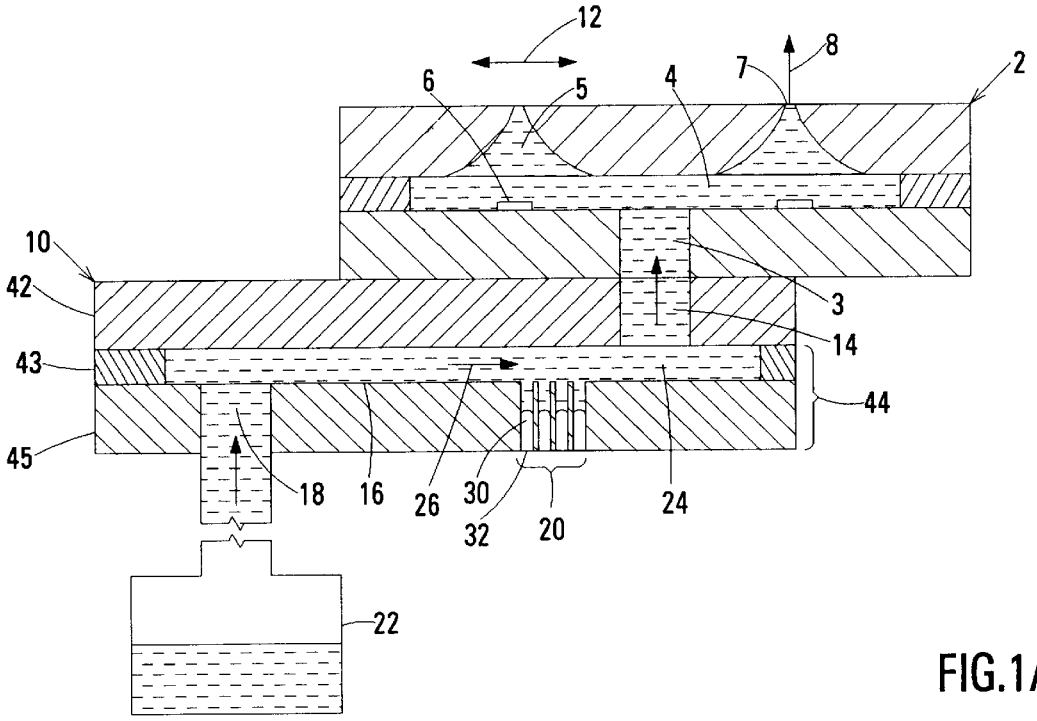
FIG. 1A is a cross-sectional view of a first embodiment of a pressure regulator according to the invention. The pressure regulator is shown attached to the print head of an ink-jet printer.
Figure 1B:
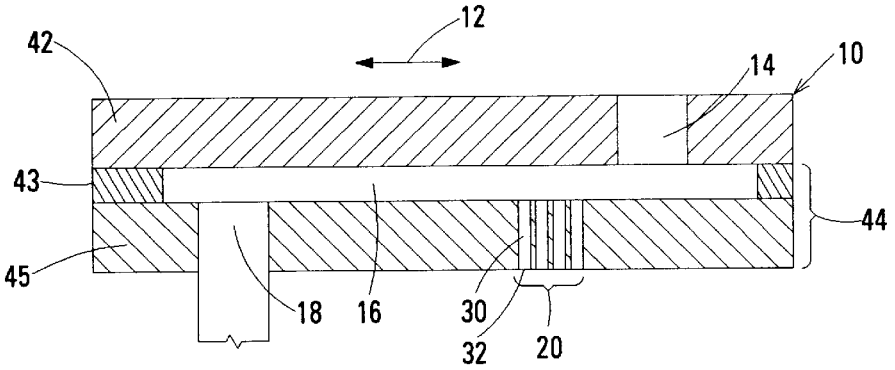
FIG. 1B is a cross-sectional view of the first embodiment of a pressure regulator according to the invention in which the ink has been omitted to show the structural features of the pressure regulator more clearly.
Figure 1C:
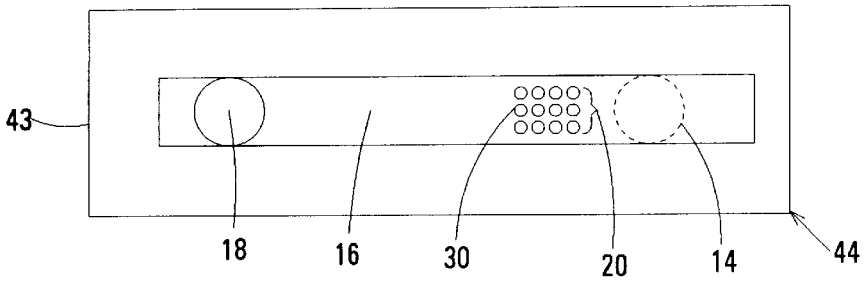
FIG. 1C is top view of the chip 44 that forms part of the embodiment of the pressure regulator shown in FIG. 1B.

A first embodiment 10 of a pressure regulator according to the invention is shown in FIGS. 1A, 1B and 1C. In this embodiment, the capillaries constituting the capillary array of the pressure regulator are oriented with their long axes aligned perpendicular to the major surface of the substrate 45 that forms part of the pressure regulator.

FIG. 1A shows the pressure regulator 10 located behind the print head 2. The pressure regulator and the print head form part of a print cartridge (not shown). In the example shown, the pressure regulator and the print head are shown as separate components. Alternatively, the pressure regulator may be integrated with the print head.

In the print head 2, ink is received from the pressure regulator 10 through the ink input 3. The manifold 4 distributes the ink to the individual firing chambers, an exemplary one of which is shown at 5. In response to a control signal, the firing element 6, which may be a micro heater or a piezoelectric element, for example, located in the firing chamber causes the orifice 7 to direct minute drops of the ink towards the paper (not shown) in the direction indicated by the arrow 8. The number of firing chambers shown is greatly reduced to simplify the drawing.

The pressure regulator 10 includes the ink outlet 14, the ink delivery channel 16, the ink inlet 18 and the capillary array 20. The ink delivery channel connects the ink outlet to the ink inlet in a manner that allows ink to flow from the ink inlet to the outlet, as shown in FIG. 1B. The ink delivery channel is also shown in FIG. 1C, which is a top view of the chip 44 that forms part of the pressure regulator 10. In this FIG., and also in FIGS. 3B, 3D, 4, 5D, 5E, 5G–5I, 6B 7 and 8, the location of the ink outlet 14 in the cover 42 is indicated by a broken line.

The capillary array 20 is in fluid communication with a point located on the ink delivery channel 16 that is preferably closer to the ink outlet than to the ink inlet. The pressure regulator receives ink 24 at the ink inlet 18. The ink is supplied by the ink reservoir shown schematically at 22 in FIG. 1A. The ink reservoir may form part of the print cartridge (not shown), or may be connected to the print cartridge by an ink delivery tube (not shown). The ink flows through the ink delivery channel from the ink inlet to the ink outlet in the direction indicated by the arrow 26. The ink outlet 14 is coupled to the ink input 3 of the print head 2.

The capillary array 20 is composed of a large number of substantially similar capillaries in a substantially planar arrangement. Each of the capillaries has a circular, elliptical, square, rectangular or other suitable cross-sectional shape, and is elongate, i.e., its length is greater than its width. To simplify the drawing, the capillary array is shown as being composed of a two-dimensional array of twelve capillaries. In practical embodiments, the capillary array would be composed of a substantially greater number of capillaries. The actual number of capillaries depends on the required ink storage capacity of the capillary array, and the ink capacity of each capillary. The required ink storage capacity depends on such factors as the maximum rate of ink flow through the ink delivery channel 16. The ink capacity of each capillary depends in part on the predetermined pressure differential, since the predetermined pressure differential determines the cross-sectional dimensions of the capillary.

A representative capillary forming part of the capillary array 20 is indicated by the reference numeral 30. One end of the capillary 30 is in fluid communication with the ink delivery channel 16, and the capillary extends through the thickness of the substrate 45 from the ink delivery channel. The capillary array is shown in direct fluid communication with the ink delivery channel in FIG. 1C. The capillary array may alternatively be in fluid communication with a side channel (see FIG. 5G) that is in turn in fluid communication with the ink delivery channel.

The open end 32 of the capillary 30 remote from the ink delivery channel 16 is in pressure communication with a source of a reference pressure relative to which the ink pressure in the ink delivery channel is referenced. In the embodiment shown, the ink pressure in the ink delivery channel is referenced to atmospheric pressure, so the end of the capillary remote from the ink delivery channel is in pressure communication with the atmosphere. In other applications, the end of the capillary remote from the ink delivery channel may be in pressure communication with a source of a reference pressure at a pressure different from atmospheric pressure.

The fluid communication between the ink delivery channel 16 and the capillary array 20 enables the ink 24 to flow into the capillaries constituting the capillary array in addition to flowing into the ink outlet 14. In each capillary constituting the capillary array, the ink forms a meniscus across which a pressure drop occurs due to the surface tension of the ink and the contact angle between the ink and the capillary.

Figure 2:
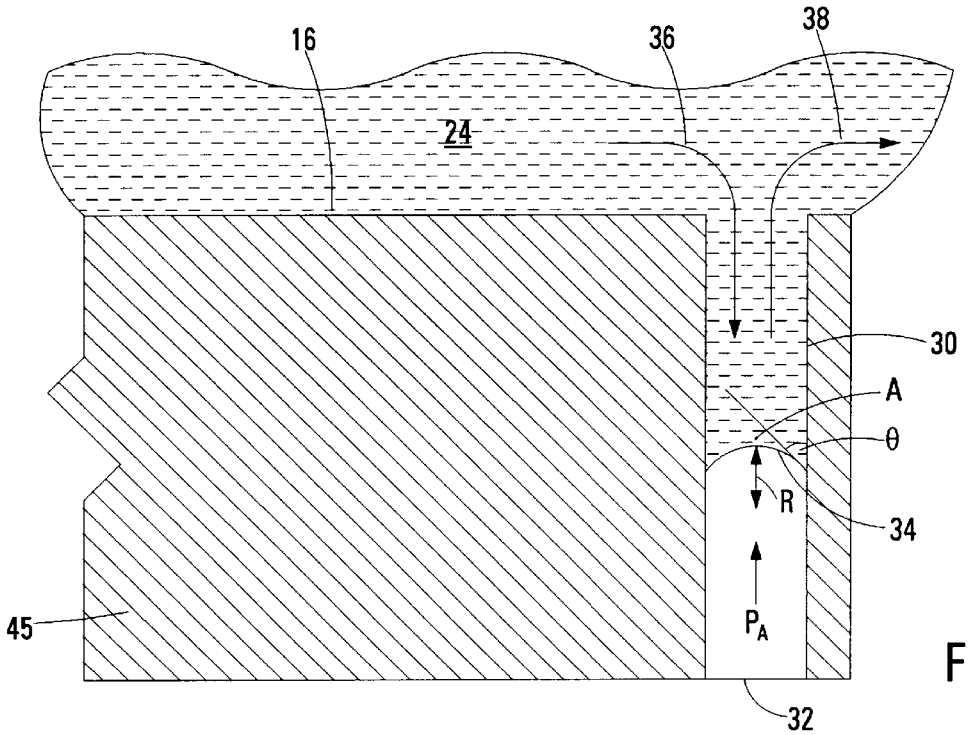
FIG. 2 is a cross-sectional view showing part of the ink delivery channel and an exemplary capillary in the first embodiment of the pressure regulator shown in FIG. 1A.

FIG. 2 shows an enlarged view of the representative capillary 30. In this, atmospheric pressure $P_A$ acts through the open end 32 of the capillary on the ink surface 34. However, due to the surface tension of the ink and the contact angle between the ink and the capillary, the pressure at the point A on the ink side of the ink surface is less than atmospheric pressure. The difference between the pressure at the point A and the pressure in the ink delivery channel, which can reflect the ink supply pressure, draws ink into the capillary, as indicated by the arrow 36. The flow of ink into the capillary array through the ink delivery channel 16 reduces the ink pressure in the ink delivery channel. The ink continues to flow into the capillary array from the ink delivery channel until the pressure in the ink delivery channel becomes equal to the pressure at the point A on the ink side of the ink surface 34 or until the capillaries are filled.

If, due to a demand for ink at the ink outlet 14, or a reduction in the supply pressure at which ink is supplied to the ink inlet 18, for example, the ink pressure in the ink delivery channel 16 falls below the pressure at the point A on the ink side of the ink surface 34, ink will be drawn out of the capillary array 20 into the ink delivery channel, as indicated by the arrow 38. Ink continues to flow out of the capillary array until the pressure in the ink delivery channel once more becomes equal to the pressure at the point A or until the capillaries are empty. Reduction of the supply pressure may occur, for example, as a result of the closing of a valve (not shown) located upstream of the capillary 30.

Accordingly, the capillary array 20 regulates the ink pressure in the ink delivery channel 16 to a pressure equal to the pressure at the point A on the ink side of the ink surface 34. The pressure at the point A is a predetermined pressure differential below the atmospheric pressure $P_A$. Consequently, the capillary array regulates the ink pressure in the ink delivery channel to a predetermined pressure differential below atmospheric pressure.

The pressure differential relative to atmospheric pressure $P_A$ is set by the pressure drop across the ink surface 34. The pressure drop across this interface depends on the surface tension $\gamma$ of the ink 24, the angle of contact $\theta$ between the ink and the wall of the capillary 30, and the cross-sectional shape and dimensions of the capillary. When the capillary has a circular cross section, the pressure differential is given by $(2\gamma/r)\cos\theta$, where r is the radius of the capillary. The angle of contact $\theta$ between the ink surface and the surface of the capillary depends on the material and cleanliness of the surface of the capillary. When the capillary has an elliptical, square or rectangular cross section, the relationship between the pressure differential and the dimensions of the capillary is more complex, but the cross sectional dimensions required to provide a required pressure differential across the ink surface 34 can nevertheless be calculated. In practical embodiments, a pressure differential in the range of 50–170 mm of water is required, with a preferred pressure differential of about 100 mm of water. In practical embodiments, capillaries about 50 $\mu$m square give pressure differentials in this range.

Since the capillary array 20 has a finite ink storage capacity, the capillary array is preferably used as a final ink pressure regulator to regulate the pressure at which the ink 24 is delivered to the ink outlet 14. Accordingly, it is preferred that some form of pre-regulation be applied to the ink supply pressure upstream of the capillary array. For example, in an on-axis arrangement, in which the ink reservoir forms part of, or is attached to, the print cartridge, the ink reservoir is preferably fitted with a pressure regulation device, such as a bubble generator, to perform such pre-regulation of the ink supply pressure. In an off-axis arrangement, the pump that delivers ink from the off-axis reservoir to the print cartridge may pre-regulate the ink supply pressure. However, as noted above, the ink supply pressure is subject to short-term variations notwithstanding such pre-regulation of the ink supply pressure. The capillary array substantially reduces the effect of such short-term variations in the ink supply pressure and ensures that the ink is delivered to the ink outlet at a predetermined pressure differential below atmospheric pressure. Other forms of ink pressure pre-regulation will be described below.

Although the pressure regulator 10 can be fabricated using conventional techniques, the preferred embodiment of the pressure regulator is fabricated in part by using micromachining techniques on materials such as single-crystal silicon. The use of micromachining to fabricate small mechanical structures in silicon is known and will not be described in detail here. A large number of pressure regulators identical to the pressure regulator 10 are formed by forming structural elements of the pressure regulators in and on a single-crystal silicon wafer, bonding the wafer to a cover sheet in which the ink outlets for the pressure regulators are formed, and dividing the resulting structure into individual pressure regulators. The cover sheet may be a sheet of metal or plastic, or may be another silicon wafer. As a further alternative, if the pressure regulator is integrated with a print head that includes a silicon chip, the silicon wafer on which the print heads are made can be used as the cover sheet. FIGS. 1A and 1B show the cover plate 42 and the chip 44 that collectively form the pressure regulator 10. The cover plate 42 and the chip 44 were originally parts of the above-mentioned cover sheet and the above-mentioned silicon wafer, respectively.

The ink outlet 14 extends through the thickness of the cover plate 42. The chip 44 includes the silicon substrate 45 that supports the barrier layer 43. The barrier layer may be a layer of polyimide, but other suitable organic or inorganic materials can be used instead of polyimide. In a preferred embodiment, the barrier layer is a layer of a so-called high aspect ratio photoresist, such as SU-8 epoxy-based photoresist sold by MicroChem Corp., Newton, Mass. 02164-

1418. The layer of photoresist of the required thickness is spun on or laminated onto the substrate to form the barrier layer, and the ink delivery channel 16 is defined in the barrier layer by selectively removing parts of the barrier layer using a conventional photomasking and developing process.

Alternatively, ink delivery channels may be wholly or partly formed in the silicon wafer by selectively removing parts of the silicon wafer using a conventional photomasking, developing and etching process, for example. As a further alternative, the ink delivery channels may be wholly or partly formed in the cover sheet using a conventional photomasking, developing and etching process, or a conventional molding process, for example. When the ink delivery channels are wholly formed in the wafer or the cover sheet, the barrier layer may be omitted.

Although the ink inlet 18 is shown as extending through the thickness of the silicon substrate 45 and the ink outlet 14 is shown as extending through the thickness of the cover plate 42, the ink inlet may alternatively extend through the barrier layer 43 or the cover plate 42 and the ink outlet may alternatively extend through the barrier layer or the substrate.

In the embodiment shown in FIGS. 1A–1C, the capillaries constituting the capillary array 20 are formed by etching through the thickness of the portion of the silicon substrate 45 that communicates with the ink delivery channel 16. The capillaries may be formed using an anisotropic etch process, such as reactive ion etching, but other processes capable of forming elongate holes with circular, elliptical or other defined cross-sectional shapes in silicon, as shown in FIGS. 1B and 1C, are known in the art and can be used. FIG. 1C shows an embodiment in which the capillary array 20 is composed of a two-dimensional array of capillaries. The number of capillaries in the array is reduced to simplify the drawing. The capillary array may alternatively be a one-dimensional array.

After the above-described structural elements have been formed in the cover sheet and the silicon wafer, the cover sheet and the silicon wafer are bonded together face-to-face using a suitable adhesive. The resulting structure is then divided into individual pressure regulators. Several hundred pressure regulators can be made simultaneously from a structure that includes one 200 mm-diameter silicon wafer.

As an alternative to reactive ion etching, the capillaries constituting the capillary array 20 may be made using a double-sided anisotropic wet etch process. This requires that the major surfaces of the silicon substrate 45 coincide with the 110 crystal plane or the 100 crystal plane. When the major surfaces of the substrate coincide with the 110 crystal plane, the double-sided wet etch produces trapezoidal capillaries. When the major surfaces of the silicon substrate 45 coincide with the 100 crystal plane, a carefully timed etch produces capillaries with substantially straight walls. While capillaries with trapezoidal walls are less preferred than capillaries with a circular cross section, or the need to time the etch with the precision needed to achieve straight capillary walls can be burdensome, the double-sided wet etch process is substantially cheaper than reactive ion etching.

If the requirement that the 110 or 100 crystal plane coincide with the major surfaces of the substrate 45 would make it difficult to form the other features formed in the substrate, a large through hole can be etched in the substrate instead of the capillary array. The above-mentioned double-sided anisotropic wet etch process can be used to form capillary arrays in an additional silicon wafer whose major surfaces coincide with the 110 or 100 crystal plane. Prior to dividing the wafer and cover sheet into individual pressure regulators, the additional wafer is bonded to the wafer with each capillary array in the additional wafer aligned with a corresponding through hole in the wafer. The assembly composed of the wafer, the additional wafer and the orifice sheet is then divided into individual pressure regulators.

Since the shapes of the structural elements formed in the chip 44 are defined by layer deposition, photomasking, developing and etching, the shapes of these structural elements can easily be optimized during production by mask changes and modifying the etch and development conditions. Such changes are much simpler to implement than changes to the molding tools, for example, used in conventional print cartridge fabrication. A mature pressure regulator design may alternatively be molded in plastic.

Figure 3A:
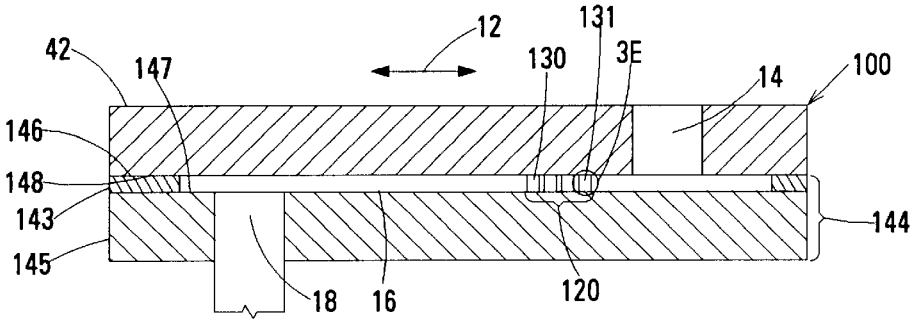
FIG. 3A is a cross-sectional view of a second embodiment of a pressure regulator according to the invention.
Figure 3B:
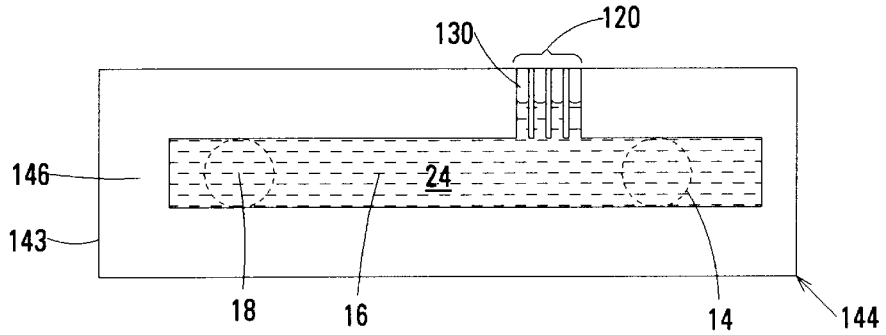
FIG. 3B is a top view of the chip 144 that forms part of the embodiment of the pressure regulator shown in FIG. 3A. In this drawing, ink is shown filling the ink delivery channel and part of the capillary array.

A pressure regulator 100 incorporating a second embodiment of a pressure regulator according to the invention is shown in FIGS. 3A and 3B. In this embodiment, the capillaries constituting the capillary array 120 of the pressure regulator are oriented with their long axes parallel to the major surface 147 of the substrate 145 that forms part of the pressure regulator. Elements of the embodiment shown in FIGS. 3A and 3B that correspond to the embodiment shown in FIGS. 1A and 1B are indicated using the same reference numerals. In the embodiment shown in FIGS. 3A and 3B, fabrication of the capillary array 120 is substantially simplified by making the capillary array a one-dimensional array, and locating the capillary array at the surface of the chip 144 in which the ink delivery channel 16 is located. Locating the capillary array at the surface of the chip 144 enables the capillaries to be fabricated by forming a row of trenches extending through the barrier layer 143 from the major surface 146 of the barrier layer to the major surface 147 of the substrate 145. The trenches can be formed in the same operation that defines the ink delivery channel in the barrier layer 143. The walls of the trenches and the major surfaces 147 of the substrate and 148 of the cover plate 42 define the capillaries in this embodiment. This way of forming the capillary array 120 is simpler and lower in cost than the anisotropic etch process required to form the capillary array 20 in the embodiment shown in FIGS. 1A and 1B. The ink capacity of the pressure regulator may be increased by locating two capillary arrays on opposite sides of the ink delivery channel 16 instead of the single capillary array 120 located on one side of the ink supply channel as shown in FIG. 3B.

In the embodiment shown in FIGS. 3A and 3B, the height of the capillaries is defined by the thickness of the barrier layer. The height of the capillaries may be made independent of the thickness of the barrier layer by forming the capillaries in the capillary defining layer 150 shown in FIG. 3C. The capillary defining layer is coated on the major surface 146 of the barrier layer 143. Alternatively, the capillary defining layer could be coated on the major surface 148 of the cover plate. A trench corresponding to each of the capillaries in the capillary array 120 is formed by selectively removing part of the capillary defining layer. Multiple capillary defining layers may also be used to increase the number of capillaries in the capillary array.

The capillary defining layer 150 may be an additional organic or inorganic barrier layer. However, fabrication is simplified when the capillary defining layer 150 is a layer of photoresist. When a layer of positive photoresist is used as the capillary defining layer, the trenches are formed by masking the capillary defining layer except at the locations of the trenches, exposing the capillary defining layer to ultra-violet light and developing the capillary defining layer. Developing the capillary defining layer removes the entire thickness of the parts of the capillary defining layer that were not protected by the mask. Alternatively, a negative photoresist could be used, in which case the locations of the trenches are protected by the mask. The sidewalls of the trenches formed in the capillary defining layer 150, the major surface 146 of the barrier layer 143 and the major surface 148 of the cover plate 42 define the capillaries in this embodiment.

The fabrication methods just described form the capillaries constituting the capillary array 120 with a square or rectangular cross-sectional shape. In addition, the capillaries formed by forming trenches in the barrier layer 143 or in some types of a capillary defining layer 150 may have a trapezoidal cross-sectional shape. The capillary array 120 is simpler to fabricate than the capillary array 20 of the first embodiment shown in FIGS. 1A–1C. Moreover, the capillaries can be made longer in the second embodiment than in the first embodiment because the length of the capillaries is not limited by the thickness of the silicon substrate in which the capillaries are fabricated. However, long capillaries may increase the area and cost of the chip. Finally, the capillaries of this embodiment are easy to integrate with sensors, as will be described below.

Figure 3C:
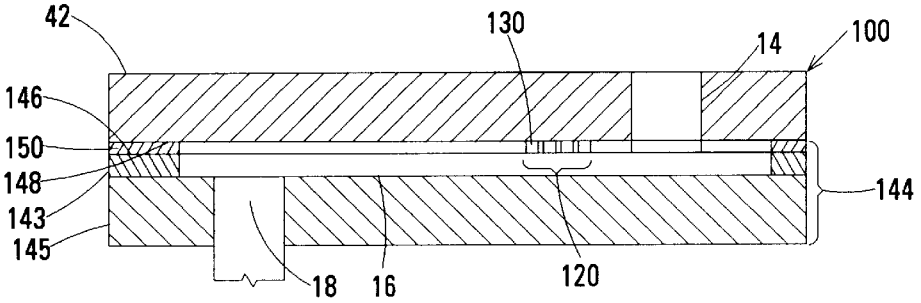
FIG. 3C is a cross-sectional view of a first variation on the embodiment of the pressure regulator shown in FIG. 3A.

Some embodiments may include both the one-dimensional array of capillaries of the embodiment shown in FIGS. 3A–3C and the two-dimensional array of capillaries of the embodiment shown in FIGS. 1A–1C. The one-dimensional array is fitted with sensors, as will be described below with reference to FIG. 5C, for example, and the two-dimensional array provides a greater storage capacity. In such embodiments, the capillaries constituting the two arrays should be dimensioned so that the pressure drop across the ink surface in the capillaries constituting the two arrays is similar or the same.

In the embodiment shown in FIGS. 3A and 3B and in the variation shown in FIG. 3C, the long axes of the capillaries constituting the capillary array 120 may be vertically oriented when the pressure regulator 100 is in its normal operating orientation. This means that, as the ink flows into the capillaries, the vertical position of the ink surface increases. The hydrostatic head of ink in the capillary reduces the pressure differential between atmospheric pressure and the ink pressure in the ink delivery channel 16. However, since the maximum variation in the vertical position of the ink surface in the capillaries is typically less than about 1 mm of ink, and the pressure drop across the ink surface in the capillaries is typically in the range of 25–170 mm of water, the variations in the ink pressure in the ink delivery channel due to hydrostatic effects are negligible.

Figure 3D:
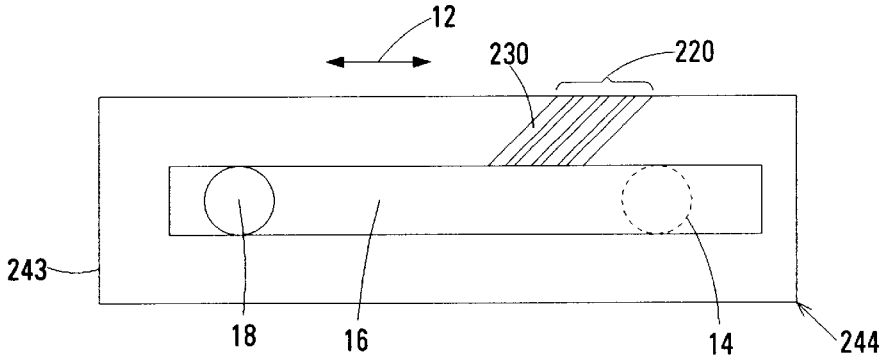
FIG. 3D is a top view of the chip that forms part of a second variation of the embodiment of the pressure regulator shown in FIG. 3A.

In both the first and second embodiments just described, the capillaries constituting the capillary arrays 20 and 120 are oriented with their long axes perpendicular to the long axis of the ink delivery channel 16. The capillaries constituting the capillary array may alternatively be set at a non-perpendicular angle to the long axis of the ink delivery channel. FIG. 3D is a top view of the chip 244 that forms part of a pressure regulator in which the capillaries constituting the capillary array 220 are at a non-perpendicular angle to the long axis of the ink delivery channel 16. Orienting the capillaries this way increases the length of the capillaries that can be accommodated in a given size of the chip 244.

Figure 3E:
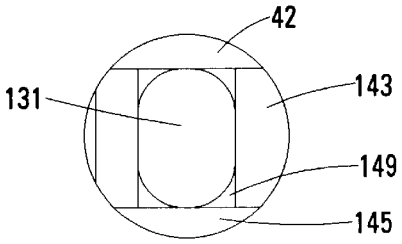
FIG. 3E is an enlarged end view of the portion 3E of FIG. 3A showing the fillets that provide the capillaries with a rounded cross section.

Wicking of the ink may occur in the corners of a capillary having a square or rectangular cross section. Wicking may be reduced to insignificant levels by rounding the square corners of the capillaries as shown in FIG. 3E. FIG. 3E is a close-up view of the end of the exemplary capillary 131. In the embodiment shown in FIG. 3A, the interface between the walls of the trenches formed in the barrier layer 143 and the major surfaces of the cover plate 42 and the substrate 145 gives the capillary 131 square corners. In the embodiment shown in FIG. 3E, each corner of the capillary 131 is filled with a fillet, an exemplary one of which is shown at 149. The fillets may be formed by filling the capillaries with a fluid plastic material, such as epoxy, and then expelling the fluid plastic material from the capillary. The surface tension of the fluid plastic material prevents the fluid plastic material from being fully expelled from the capillary, with the result that the square corners of the capillary remained filled with the fluid plastic material. Curing the fluid plastic material leaves the square corners of the capillary filled with fillets of the plastic material.

A number of variations on the embodiments of the pressure regulators described above with reference to FIGS. 1A–1C, 2 and 3A–3D will now be described. Although the variations are depicted as variations on the embodiment shown in FIGS. 3A and 3B, similar variations may be made in the embodiment shown in FIGS. 1A–1C.

In the embodiments described above with reference to FIGS. 1A–1C, 2 and 3A–3D, the capillary array 20, 120, 220 provides the final regulation of the pressure of the ink delivered to the ink outlet 14 in conjunction with a restriction to the ink flow collectively imposed by the ink delivery system upstream of the ink inlet 18 and the part of the ink delivery channel 16 upstream of the capillary array. The ability of the capillary array to regulate the pressure of the ink delivered to the ink outlet 14 may be increased by providing an additional restriction on the ink flow upstream of the capillary array.

Figure 4:
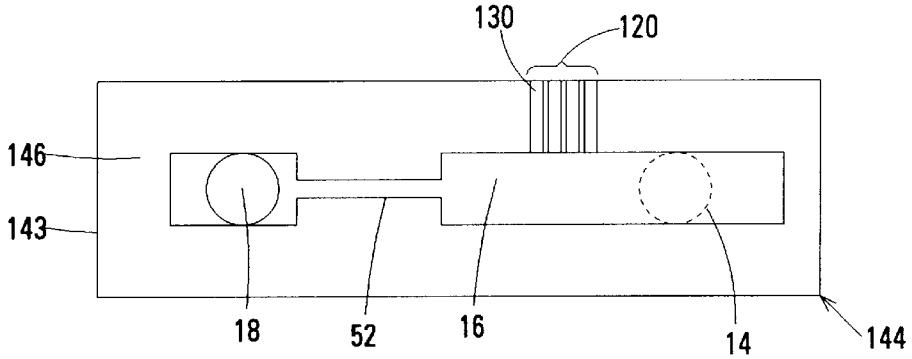
FIG. 4 is a top view of the chip that forms part of a third variation on the embodiment of the pressure regulator shown in FIG. 3A. This variation additionally includes a flow constrictor upstream of the capillary array.

FIG. 4 is a top view of the chip 144 that embodies a variation on the pressure regulator shown in FIG. 3A. In this, the ink delivery channel 16 is formed to include the constriction 52 as an example of an additional restriction on the ink flow upstream of the capillary array. The additional restriction on the ink flow increases the ability of the capillary array to regulate the pressure at which ink is delivered to the ink outlet 14, especially in embodiments in which the ink delivery system upstream of the ink delivery channel is relatively unrestricted. An additional restriction on the ink flow may be similarly incorporated in the other embodiments described above.

Figure 5A:
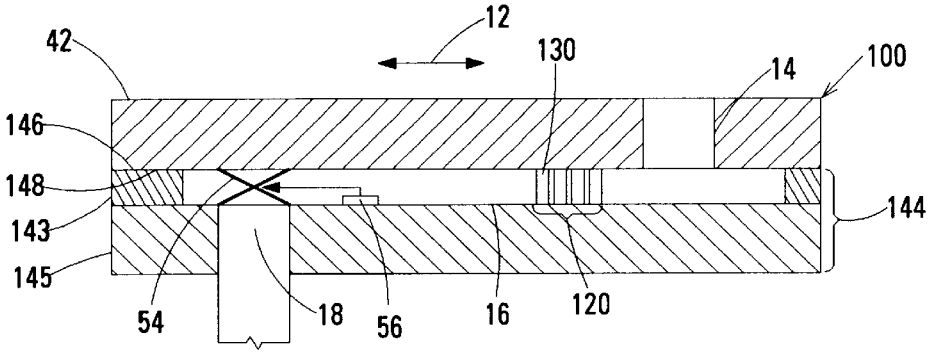
FIG. 5A is a cross-sectional view of a fourth variation of the embodiment of the pressure regulator shown in FIG. 3A in which primary pressure regulation in the ink delivery channel is provided by a valve operating in response to a sensor, such as a pressure sensor, located in the ink delivery channel.

In FIG. 5A, the passive or active valve schematically shown at 54 is located in the ink delivery channel 16 upstream of the capillary array 120. The valve may operate to cut off the flow of ink except when printing is being performed. This prevents the ink from over-filling the capillary array 120 at times that the ink outlet 14 is not drawing ink from the ink supply channel 16. The valve may additionally or alternatively act as a passive or active flow restrictor that increases the ability of the capillary array to regulate the ink pressure in the ink delivery channel. The thermally-actuated valve described in U.S. Pat. No. 5,058,856 of Gordon et al. and assigned to the assignee of this application could be used as the valve 54, for example. A further alternative is to use one of the embodiments of the bubble valve described in the United States patent application entitled Bubble Valve and Bubble Valve-Based Pressure Regulator of Leslie Field et al., filed simultaneously with this application, assigned to the assignee of this application, and incorporated by reference herein in its entirety.

The valve 54 may be a passive valve that operates in response to pressure differences across it. The valve 54 may alternatively operate in response to an external sensor or to a sensor that forms part of, or that is mounted on or in, the valve. FIG. 5A schematically shows the external sensor 56 coupled to the valve 54. In this embodiment, the sensor 56 is located in the ink delivery channel upstream of the capillary array 120 where the sensor directly detects the ink pressure in the ink supply channel. The sensor position shown is an example and the sensor may be located elsewhere. The sensor may monitor the ink pressure in the ink delivery channel, the fill state of the capillary array or some other parameter.

Figure 5B:
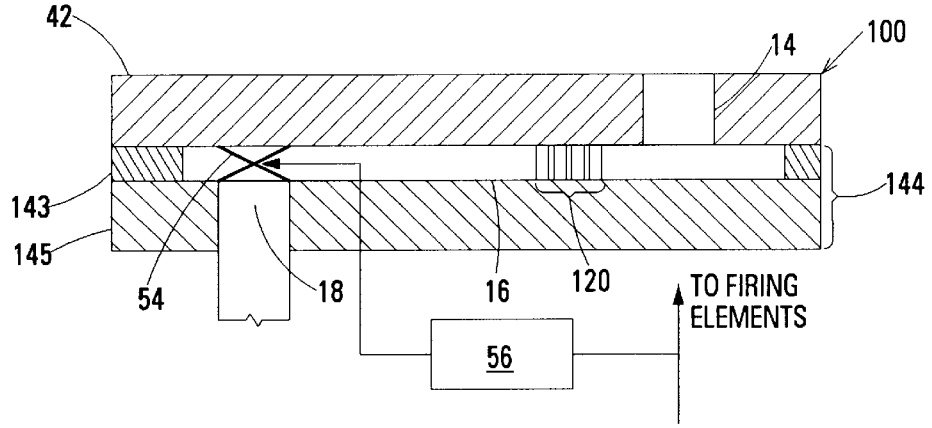
FIG. 5B is a cross-sectional view of a fifth variation of the embodiment of the pressure regulator shown in FIG. 3A in which primary pressure regulation in the ink delivery channel is provided by a valve operating in response to a sensor that calculates the ink flow in the ink delivery channel.

For example, as shown in FIG. 5B, the sensor 56 may monitor the control signals fed to the firing elements 6 in the print head (see FIG. 1A) and calculate the pressure in the ink delivery channel 16 from balance of ink supply and demand. The flow characteristics of the ink delivery system upstream of the capillary array 120 are known, as are the characteristics of the ink flow into and out of the capillary array and the quantity of ink ejected from each of the orifices at each firing of their respective firing elements. From these data, and the information gathered on the firings of the firing elements by monitoring the firing element control signals, the sensor can determine whether the valve needs to admit additional ink to the ink delivery channel to maintain the ink pressure in the ink delivery channel within the regulation range of the capillary array. When it determines that additional ink is required, the sensor feeds a control signal to the valve 54.

As a further alternative, the sensor 56 can control the valve 54 by detecting the ink level in the capillary array 120. In the example shown in FIGS. 5C and 5D, the capillary array is located between opposed electrodes 58 and 60. The electrodes form a capacitor that constitutes one arm of the a.c. bridge circuit 62 driven by the oscillator 64. The ink acts as a dielectric for the capacitor, so the capacitance of the capacitor and the output voltage of the bridge circuit depend on the level of the ink in the capillary array. The control circuit 66 monitors the output of the bridge circuit, and generates a control signal for feeding to the valve 54 in response to the bridge output. The control signal opens the valve when the bridge output indicates that the level of the ink in the capillary array has fallen below a first predetermined level and closes the valve when bridge output indicates that the ink level has risen above a second predetermined level, higher than the first.

The electrodes 58 and 60 located on opposite sides of the capillary array 120 may be formed in a number of different ways. A metal electrode may be formed on the major surface 148 of the cover plate 42 as the electrode 58. A high level of an impurity may be diffused into the major surface 147 of the silicon substrate 145 to form a conductive region as the electrode 60. The electrode 58 may be formed by coating the major surface 148 of the cover plate 42 with a layer 68 of photoresist and forming a trench in the photoresist as described above with reference to FIG. 3A. A lift-off process or other suitable process is then used to deposit metal in the trench as the electrode 58. A similar process may be used before the capillary array 120 is formed in the capillary defining layer 150 to form the electrode 60 in the photoresist layer 70. The electrodes may alternatively be formed by depositing layers of metal and patterning them to define the electrodes.

Figure 5C:
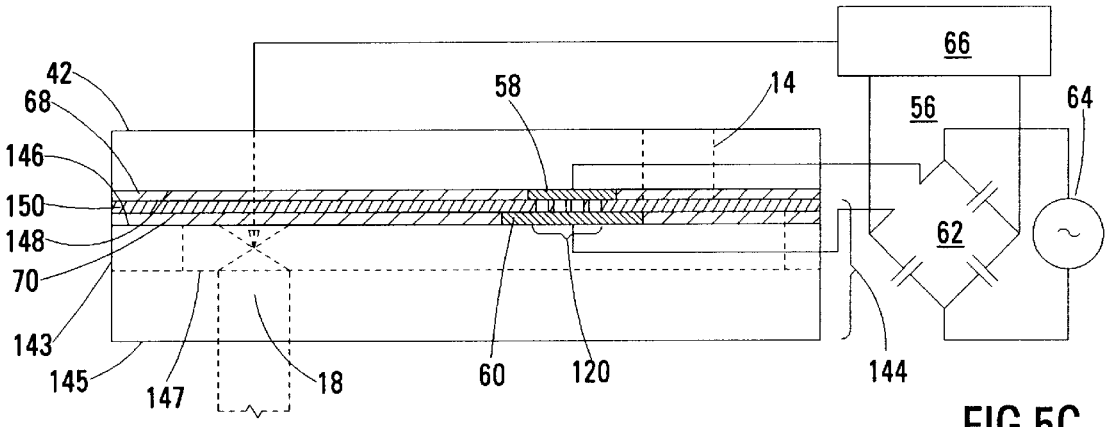
FIG. 5C is a side view of a sixth variation of the embodiment of the pressure regulator shown in FIG. 3A. In this variation, primary pressure regulation in the ink delivery channel is provided by a valve operating in response to a sensor that detects the ink level in the capillary array.
Figure 5D:
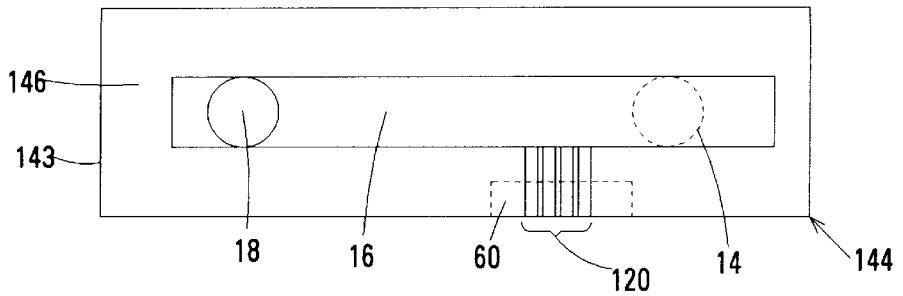
FIG. 5D is a top view of the chip that forms part of the embodiment of the pressure regulator shown in FIG. 5C.

As an alternative to the opposed electrodes 58 and 60 shown in FIG. 5C, comb electrodes may be interleaved on part of either of the major surfaces 146 and 148 next to the capillary array 120. The capacitance between the comb electrodes may be determined by connecting them to the a.c. bridge circuit 62 or in other ways.

As a further alternative, a pair of parallel elongate electrodes may be located on an insulating layer located on either of the major surfaces 146 and 148. The elongate electrodes are disposed along the length of one or more of the capillaries constituting the capillary array 120. The electrodes are located so that they detect the ink when ink is present in the capillary. In this case, the sensor 56 determines the ink level in the capillary by applying a voltage between the electrodes and measuring the resulting leakage current passing between the electrodes through the ink.

Electronic circuits that form part of the sensor 56, such as the a.c. bridge 62, oscillator 64 and control circuit 66 may be formed on a convenient surface of the silicon substrate 145 using conventional semiconductor circuit fabrication techniques.

Figure 5E:
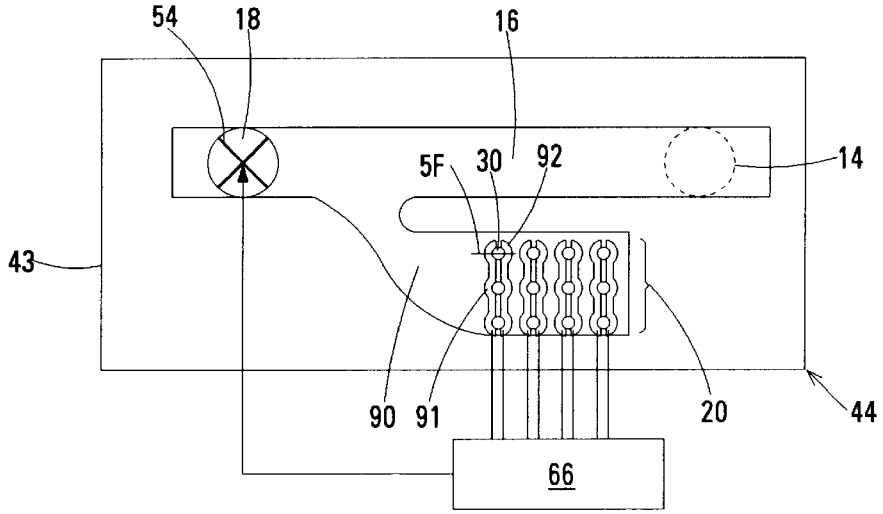
FIG. 5E is a top view of the chip that forms part of a first variation on the pressure regulator shown in FIGS. 1A–1C. In this variation, the capillary array is fitted with a sensor that detects the presence of ink in the capillaries.
Figure 5F:
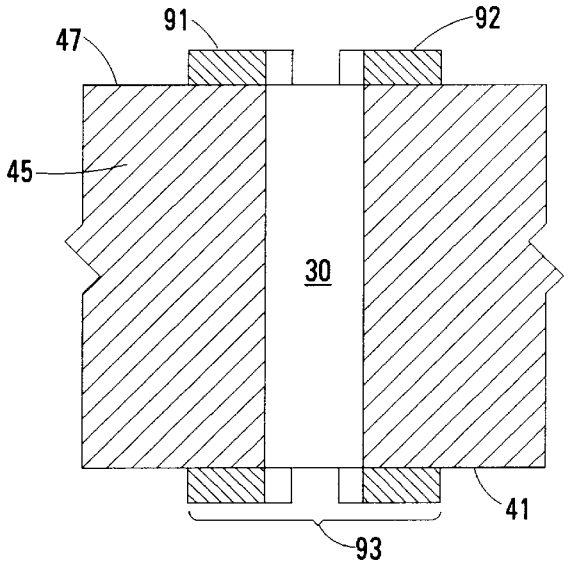
FIG. 5F is an enlarged cross sectional view of the portion 5F indicated in FIG. 5E and additionally shows an optional second electrode.
Figure 5G:
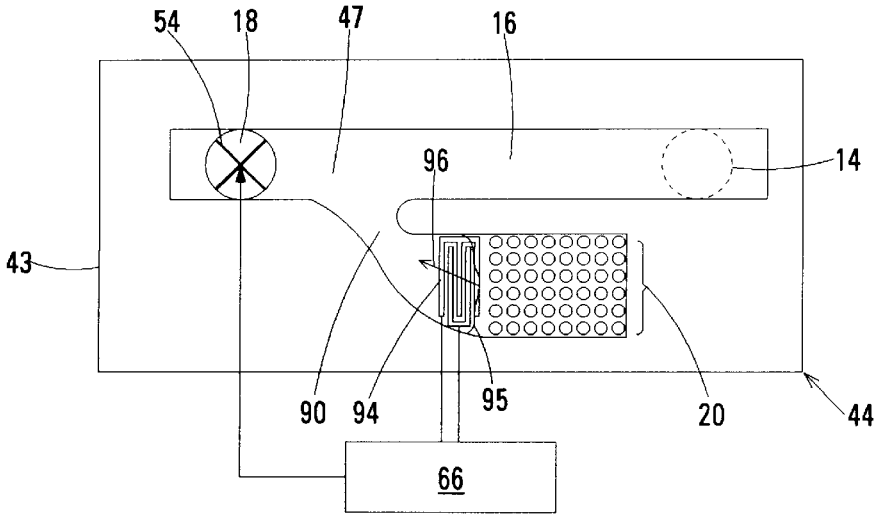
FIG. 5G is a top view of the chip that forms part of a second variation on the pressure regulator shown in FIGS. 1A–1C. In this variation, the capillary array is fitted with a sensor that detects the presence of ink in the side branch of the ink delivery channel.

FIGS. 5E–5G illustrate two ways of indirectly detecting the fill state of the embodiment of the capillary array shown in FIGS. 1A–1C in which the long axes of the capillaries extend through the thickness of the substrate 45. In these embodiments, the capillary array 20 is located in the side branch 90 of the ink delivery channel. In the embodiment shown in FIG. 5E and 5F, the presence of ink in a capillary is detected by a pair of opposed electrodes located on an insulating layer on the major surface 47 of the substrate 45 at the mouth of the capillary. The electrodes constituting the pair of electrodes are electrically connected to the control circuit 66. In the embodiment shown, the capillaries in each column of the capillary array 20 share a single pair of electrodes to reduce the number of connections to the control circuit. For example, the column of capillaries that includes the exemplary capillary 30 all share the pair of electrodes composed of the electrodes 91 and 92. Individual electrodes may be installed on fewer than all of the capillaries in the capillary array as an alternative way of reducing the number of electrical connections to the control circuit 66.

The control circuit 66 detects the presence of ink in the capillary by measuring the capacitance, the conductance or the capacitance and conductance between the electrodes 91 and 92. The ink acts as a dielectric and a conductor, so the capacitance and conductance between the electrodes is higher when ink is present in the capillary than when the capillary is empty.

The type of fill state detection just described can be made more progressive by including capillaries of different diameters in the capillary array 20. The diameters of the capillaries may progressively increase with increasing distance from the junction between the ink delivery channel 16 and the side branch 90 so that the capillaries closer to the junction have a diameter smaller than the average diameter of all the capillaries, and the capillaries remote from the junction have a diameter larger than the average diameter. Alternatively, most of the capillaries in the capillary array can have the same diameter, which will be called the average diameter, and one or more of the capillaries closest to the junction between the ink delivery channel and the side branch may have a diameter smaller than the average diameter, and one or more of the capillaries furthest from the junction may have a diameter larger than the average diameter.

Pairs of electrodes are located at the mouths of at least the capillaries with diameters different from the average diameter. The capillaries that are smaller than the average diameter fill before and empty after the capillaries of average diameter. The capillaries that are larger than the average diameter fill after and empty before the capillaries of average diameter. Thus, by monitoring whether ink in present in the smaller- and larger-diameter capillaries as well as monitoring whether ink is present in capillaries of average diameter, the control circuit 66 can deduce the fill state of the capillaries constituting the majority of the capillary array.

Additional electrode pairs may be located on the major surface 41 of the substrate 45 opposite the major surface 47 to detect when the capillaries constituting the capillary array 20 are full. For example, the electrodes constituting the additional electrode pair 93 surround the mouth of the capillary 30 in the major surface 41 in the same way as the electrodes 91 and 92 surround the mouth of the capillary 30 in the major surface 47. The additional electrode pairs are connected to the control circuit 66. As with the electrode pairs on the major surface 47, using multiple pairs of electrodes on the major surface 41, preferably in conjunction with capillaries of different diameters, enables the filling of the capillary array to be controlled more accurately.

In the embodiment shown in FIG. 5G, the location of the ink surface 95 as the capillary array 20 fills and empties is detected. The comb electrode array 94 is located on the major surface 47 of the substrate between the capillary array and the junction between the ink delivery channel 16 and the side branch 90. The control circuit 66 detects capacitance or conductance between the electrodes constituting the comb electrode array. The capacitance or conductance depends on whether ink is present in the gap between the electrodes of the array.

When the valve 54 is closed and the printer is operating, ink is drawn into the ink delivery channel 16 from the capillary array 20 and the electrode array 94 is immersed in ink. When the amount of ink drawn into the ink delivery channel exceeds the capacity of the capillary array, the capillary array is empty of ink, and air is drawn through the capillaries into the side branch 90. The ink surface 95 advances in the direction indicated by the arrow 96 towards the junction between the ink delivery channel and the side branch. As the ink/air surface passes over the electrode array 94, the control circuit 66 detects the resulting decrease in capacitance or conductance and opens the valve 54 to admit a predetermined quantity of ink into the ink delivery channel. The quantity of ink admitted is sufficient to replenish the capillary array. Alternatively, the quantity of ink admitted can be controlled in response to an additional sensor that determines when the capillary array is full. The additional electrode pair 93 shown in FIG. 5F could be used as the additional sensor.

As noted above, the sensor 56 may detect the ink pressure in the ink delivery channel. A conventional pressure sensor may be used. Alternatively, the pressure sensor may be capillary-based, as in the examples shown in FIGS. 5H and 5I.

Figure 5H:
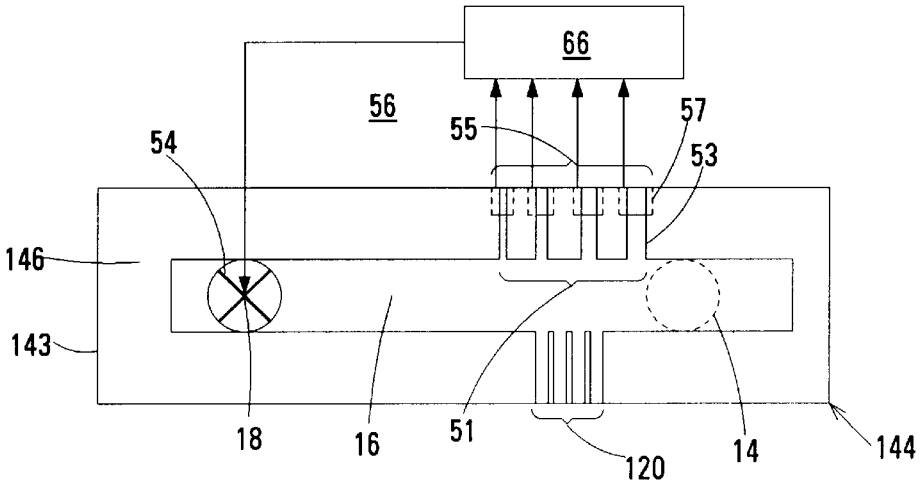
FIG. 5H is a top view of the chip that forms part of seventh a variation of the embodiment shown in FIG. 3A. In this variation, primary pressure regulation in the ink delivery channel is provided by a valve operating in response to a first embodiment of a capillary-based pressure sensor that detects the ink pressure in the ink delivery channel.

In the embodiment shown in FIG. 5H, the pressure sensor 56 is composed of the array 51 of pressure sensor capillaries. An exemplary one of the pressure sensor capillaries is indicated at 53. The pressure sensor capillary 53 extends from the ink delivery channel 16 to a location in pressure communication with the atmosphere or other source of reference pressure. Each of the pressure sensor capillaries in the array 51 has a different width. When the pressure difference between the pressure of the ink in the ink delivery channel and atmospheric pressure has a certain value, ink is present in only the pressure sensor capillaries in which the pressure drop across the ink surface in the capillary is less than the pressure difference. For example, a pressure difference exists at which ink will be present only in the smallest-width capillary. At pressure differences less than this value, the larger-width capillaries fill with ink in order of their widths.

The array 55 of electrodes detects the pressure sensor capillaries in which ink is present. In the example shown, the array detects the pressure sensor capillaries that are filled with ink as a way of detecting the presence of ink. Other indicators of the presence of ink may alternatively or additionally be used. For example, the presence of ink may be detected optically or by the cooling effect of the ink. The electrode of the exemplary pressure sensor capillary 55 is indicated at 57. The electrodes are connected to the control circuit 66. Each electrode in the electrode array generates a signal that changes in response to a change in capacitance, conductivity, resistance or other suitable parameter resulting from the presence of ink in its respective pressure sensor capillary. The control circuit determines which of the pressure sensor capillaries have ink in them in response to the signals generated by the electrode array. From its determination of which of the pressure sensor capillaries have ink in them, the control circuit calculates the pressure in the ink delivery channel 16. The control circuit controls the valve 54 in response to the calculated ink pressure.

Each of the pressure sensor capillaries constituting the pressure sensor capillary array 51 may be a single capillary or may be composed of multiple capillaries having the same width and sharing a common electrode. Multiple capillaries sharing a common electrode increases the change in the signal generated by the electrode in response to the respective pressure sensor capillary filling with ink.

Figure 5I:
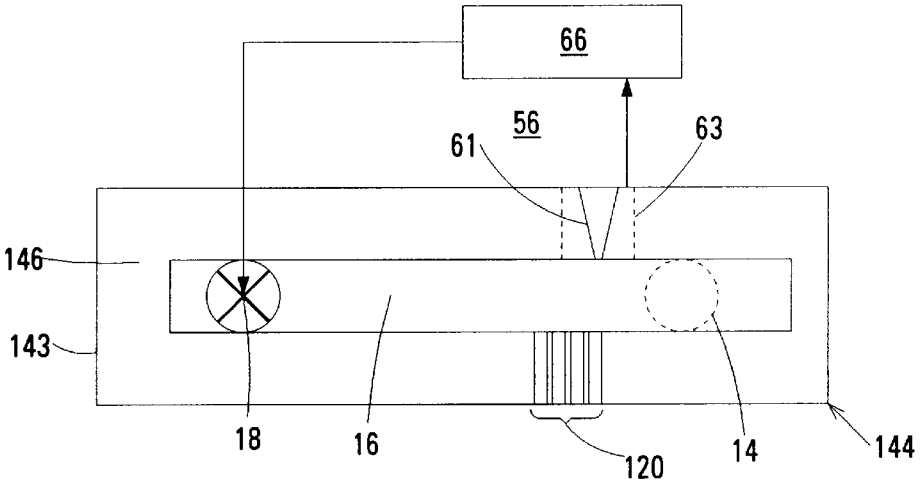
FIG. 5I is a top view of the chip that forms part of an eighth variation on the embodiment of the pressure regulator shown in FIG. 3A. In this variation, primary pressure regulation in the ink delivery channel is provided by a valve operating in response to a second embodiment of a capillary-based pressure sensor that detects the ink pressure in the ink delivery channel.

FIG. 5I shows another embodiment of a capillary-based pressure sensor 56 for determining the difference between the ink pressure in the ink delivery channel and atmospheric pressure. The pressure sensor is composed of the flared pressure sensor capillary 61 and its associated electrode 63. The electrode is connected to the control circuit 66. The flared pressure sensor capillary 61 extends from the ink delivery channel 16 to a location in pressure communication with the atmosphere or other source of reference pressure. The width of the flared pressure sensor capillary has a minimum value at the ink delivery channel and progressively, but not necessarily linearly, increases with increasing distance from the ink delivery channel. Since the pressure drop across the ink surface in the flared pressure sensor capillary depends on the width of the capillary at the ink surface, the level to which ink fills the flared pressure sensor capillary depends on the difference between the ink pressure in the ink delivery channel and atmospheric pressure.

The electrode 63 generates a signal that changes in response to a change in capacitance, conductivity, resistance or other suitable parameter resulting from the level of the ink in the flared pressure sensor capillary. From the value of the signal generated by the electrode, the control circuit calculates the pressure of the ink in the ink delivery channel. Alternatively, the electrode may be segmented into a number of sub-electrodes arrayed perpendicular to the long axis of the ink delivery channel 16. The sub-electrodes are connected to the control circuit 66. Each sub-electrode generates a signal whose state depends on whether or not ink is present in the flared pressure sensor capillary adjacent the sub-electrode. From the states of the signals generated by the sub-electrodes, the control circuit calculates the pressure of the ink in the ink delivery channel.

In the embodiment of the pressure sensor 56 shown in FIG. 5I, the accuracy of the pressure detection may be increased by using multiple flared pressure sensor capillaries. The flared pressure sensor capillaries may share a common electrode or electrode array, or each of the flared pressure sensor capillaries may have its own electrode.

The maximum ink flow rate of some ink jet print heads can exceed 0.5 ml/s. To provide such flow rates, the ink must be supplied to the pressure regulator at a pressure greater than atmospheric pressure, yet the pressure at which the ink is delivered to the print head should still be maintained at a pressure differential in the range of 25–170 mm of water below atmospheric pressure. In such pressure regulators, a multi-valve arrangement, examples of which are shown in FIGS. 6A and 6B, can be used to enable the capillary array to regulate the ink pressure of the ink fed to the print head notwithstanding the high ink delivery pressure.

Figure 6A:
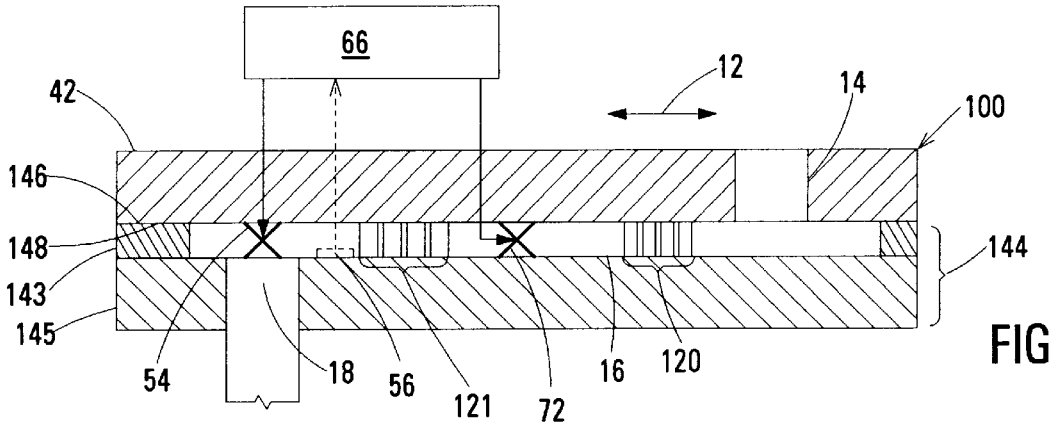
FIG. 6A is a cross-sectional view of a ninth variation of the embodiment of the pressure regulator shown in FIG. 3A. In this variation, primary pressure regulation in the ink delivery channel is provided by two valves and a second capillary array disposed along the ink delivery channel.
Figure 6B:
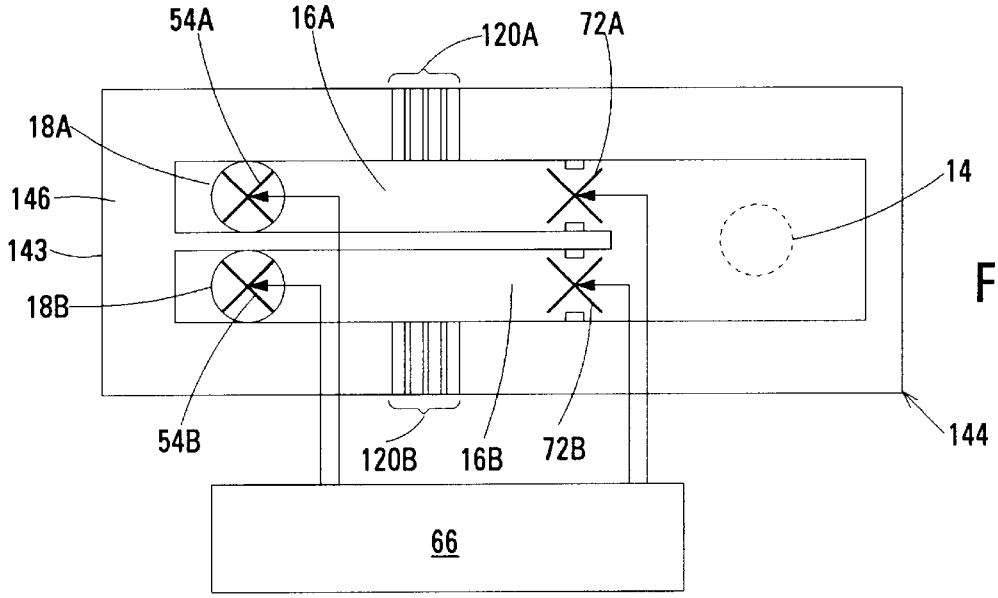
FIG. 6B is a top view of the chip that forms part of a tenth variation on the embodiment of the pressure regulator shown in FIG. 3A. In this variation, primary pressure regulation is provided by two parallel ink delivery channels controlled by valves.

In the example shown in FIG. 6A, the second capillary array 121 is in fluid communication with the ink delivery channel 16 at a location upstream of the first capillary array 120. A first valve, shown schematically at 54, controls the flow of ink from the ink inlet 18 to the ink delivery channel. A second valve, shown schematically at 72, controls the flow of ink through the ink delivery channel between the first capillary array and the second capillary array 120.

The control circuit 66 controls the first valve 54 and the second valve 72. A simpler embodiment of the control circuit drives the first and second valves in anti-phase, so that the valve 72 is closed when the valve 54 is open and vice versa. Consequently, when the first valve 54 is open, the ink pressure at the ink inlet 18 drives the ink into the second capillary array 121 and the closed second valve 72 isolates the ink outlet 14 and the first capillary array 120 from the ink pressure at the ink inlet. When the first valve is closed, the ink delivery channel is isolated from the ink pressure at the ink inlet. Ink can then flow from the second capillary array 121 to the first capillary array 120 and the ink outlet 14 through the open second valve 72.

The capillaries constituting the second capillary array 121 are dimensioned so that the pressure drop across the ink surface in the capillaries is less than that in the capillaries constituting the first capillary array 120, but is still within the range of the pressure differential required by the ink outlet 14. The difference in the pressure differentials of the two capillary arrays enables the first capillary array to draw ink from the second capillary array when the second valve 72 is open.

The control circuit 66 is shown as operating in response to the pressure sensor 56 located in the ink delivery channel 16 between the first valve 54 and the second capillary array 121. The pressure sensor may be located elsewhere, such as between the second valve 72 and the first capillary array 120. The control circuit may alternatively operate in response to detecting the firings of the firing elements 6 (see FIG. 1A), as described above with reference to FIG. 5B. As a further alternative, the control circuit may operate in response to a sensor that detects the ink level in one or, preferably, both of the capillary arrays in a manner similar to that described above with reference to FIG. 5C.

A more sophisticated version of the control circuit 66 may alternatively operate the first and second valves 54 and 72 individually. The control circuit may open and close the second valve some time before or after it respectively closes or opens the first valve. Overlapping the times that the valves are open increases ink throughput at the expense of a less-constant ink pressure at the ink outlet 14. Overlapping the times that the valves are closed minimizes variations in the ink pressure at the ink outlet at the expense of a reduced maximum throughput of ink.

In the example shown in FIG. 6B, parallel ink delivery channels 16A and 16B formed in the chip 144 both feed the ink outlet 14. Each ink delivery channel has an ink inlet 18A, 18B controlled by a first valve 54A, 54B. The ink inlets 18A, 18B both receive ink from an ink supply (not shown). A capillary array 120A, 120B is in fluid communication with each of the ink delivery channels. The example is also shown as including a second valve 72A, 72B located in each of the ink delivery channels between the capillary array and the ink outlet. In less demanding applications, the second valves may be omitted.

A simple version of the control circuit 66 controls the valves 54A and 72B in antiphase relative to the valves 54B and 72A so that the valves 54A and 72B are open when the valves 54B and 72A are closed and vice versa. When the valve 54A is open, the ink supply pressure at the ink inlet 18A forces ink into the capillary array 120A but the closed valve 72A isolates the ink outlet 14 from the ink supply pressure. The open valve 72B enables the capillary array 120B to control the ink pressure in the ink outlet. The closed valve 54B isolates the ink delivery channel 16B, the capillary array 120B and the ink outlet from the ink supply pressure at the ink inlet 18B. When the valve 54B is open, the ink supply pressure at the ink inlet 18B forces ink into the capillary array 120B but the closed valve 72B isolates the ink outlet from the ink supply pressure. The open valve 72A enables the capillary array 120A to control the ink pressure at the ink outlet. The closed valve 54A isolates the ink delivery channel 16A, the capillary array 120A and the ink outlet from the ink supply pressure at the ink inlet 18A.

The embodiment may be further simplified by omitting the downstream valves 72A and 72B.

The control circuit 66 may operate in response to pressure sensors (not shown) located in the ink delivery channels 16A and 16B. For example, the pressure sensors may be located between the first valves 54A, 54B and the capillary arrays 120A and 120B, respectively. A single pressure sensor may be located in the common portion of the ink delivery channels upstream of the ink outlet 14. The control circuit may alternatively operate in response to detecting the firings of the firing elements 6 (see FIG. 1A), as described above with reference to FIG. 5B. In a preferred embodiment, the control circuit operates in response to sensors that detect the ink levels in the capillary arrays 120A and 120B. Examples of suitable sensors are described above with reference to FIGS. 5C–5G.

A more sophisticated version of the control circuit 66 may operate the valves 54A, 72B and 54B, 72A independently. In each ink supply channel, the control circuit may open and close the valves 72A, 72B some time before or after it respectively closes or opens the valves 54A, 54B.

The surface tension and viscosity of a liquid are temperature-dependent. Consequently, in a print head incorporating the pressure regulator according to the invention, the differential between the ink pressure in the ink delivery channel and atmospheric pressure may be varied by varying the temperature of the ink in the capillary array. An ability to control the pressure at which the ink is delivered to the ink outlet is advantageous in an ink-jet printer since the ink pressure influences the size of the ink drops ejected from the orifice. Small adjustments to the grey scale of monochromatic printing and the saturation and hue of color printing can be made by varying the size of the ink drops. In addition, the rate at which the capillaries empty can be controlled by changing the temperature of the ink to alter the viscosity of the ink.

Figure 7:
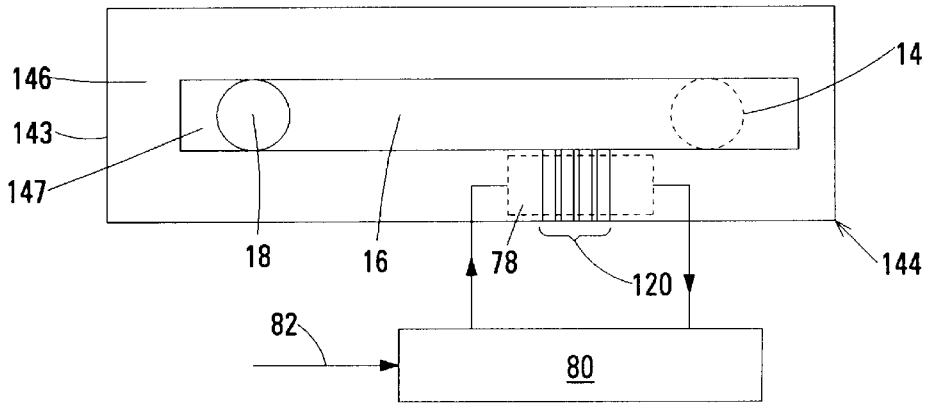
FIG. 7 is a top view of the chip that forms part of an eleventh variation on the embodiment of the pressure regulator shown in FIG. 3A. In this variation, the temperature of the ink in the capillary array is controlled.

FIG. 7 shows an example of the chip 144 that forms part of an embodiment of a pressure regulator in which the ink temperature in the capillary array can be varied to set the ink pressure in the ink delivery channel to a controlled differential below atmospheric pressure or to control the rate at which the capillaries empty.

In the chip 144 shown in FIG. 7, elements that are the same as elements of the chip shown in FIG. 3B are indicated by the same reference numeral and will not be described again here. The temperature control element 78 is located adjacent the capillary array 120. In the chip shown in FIG. 7, the temperature control element is located in the chip 144 underlying the capillary array. The temperature control element could additionally or alternatively be located in the cover plate 42 overlying the capillary array. The temperature control element may be a region of impurities diffused into the major surface 147 of the silicon substrate that forms part of the chip 144 to form a resistor in the substrate. Electrodes are located on opposite ends of the resistor so that current passed through the resistor from one of the electrodes to the other generates heat.

Alternatively, the temperature control element 78 may be a layer of an electrically-resistive material sandwiched between the surface of the silicon substrate and the capillary array 120. An electrically insulating but thermally conductive layer may be interposed between the capillary array and the ink if necessary. Current is passed from end-to-end through the resistive material to generate heat. The layer of electrically-resistive material may be a layer of metal located on the major surface 147 of the silicon substrate or in the barrier layer 143 under the capillary array by a process similar to that described above with reference to FIG. 5C for forming the electrode 60.

The temperature control element 78 can provide cooling in addition to heating. This can be done, for example, by using an array of bimetallic junctions as the temperature control element. The temperature control element providing cooling in addition to heating increases the temperature range over which the temperature of the ink can be varied and makes the temperature range independent of the ambient temperature. The temperature control element providing cooling also increases the rate at which the temperature of the ink can be reduced compared to relying on natural cooling.

The temperature of the temperature control element 78 is controlled by the temperature controller 80. The temperature controller controls the temperature of the temperature control element in response to the input 82 which specifies the desired temperature, the desired grey scale, saturation, hue, etc., the desired emptying rate, etc. The temperature controller can provide a more accurate control of the ink temperature if it monitors the temperature of the temperature control region. This can be done using a suitable sensor (not shown) in contact with the temperature control element or in contact with the ink in the capillary array, or by measuring the resistivity of the material of the heat-generating resistor. The temperature control element can additionally form part of a circuit arrangement similar to that shown in FIG. 5C in which it serves as an electrode for measuring the ink level in the capillary array 120.

Figure 8:
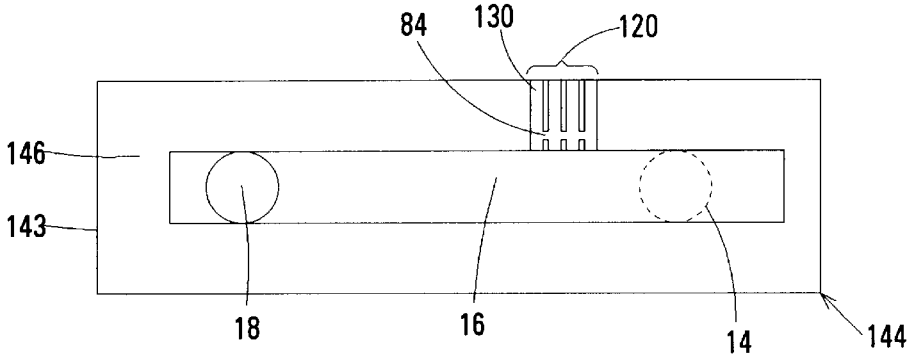
FIG. 8 is a top view of the chip 144 that forms part of a twelfth variation on the embodiment of the pressure regulator shown in FIG. 3A. In this variation, a cross connection is provided to mitigate the effects of possible clogging of the capillaries constituting the capillary array.

Some inks are composed of fine particulate matter suspended in a liquid. If the liquid is allowed to evaporate from such an ink stored in the capillary array, the ink will dry out and may deposit particulate matter in the capillaries constituting the capillary array. Fabricating the pressure regulator may also leave particulate remnants in the ink delivery channels and the capillaries. Sufficient particulate matter deposited in a capillary may block the fluid communication between the capillary and the ink delivery channel. FIG. 8 shows the chip 144 that forms part of an embodiment of a pressure regulator in which at least one cross path 84 is provided between at least some of the individual capillaries that constitute the capillary array. The cross path 84 mitigates the ill effects of clogging by particulate matter deposited in the individual capillaries, and also mitigates the ill effects of trapped air bubbles and dried-out capillaries. It is preferable to locate the cross-connection 84 near the ink delivery channel 16 and remote from the usual location of ink surface in the capillaries.

Figure 9A:
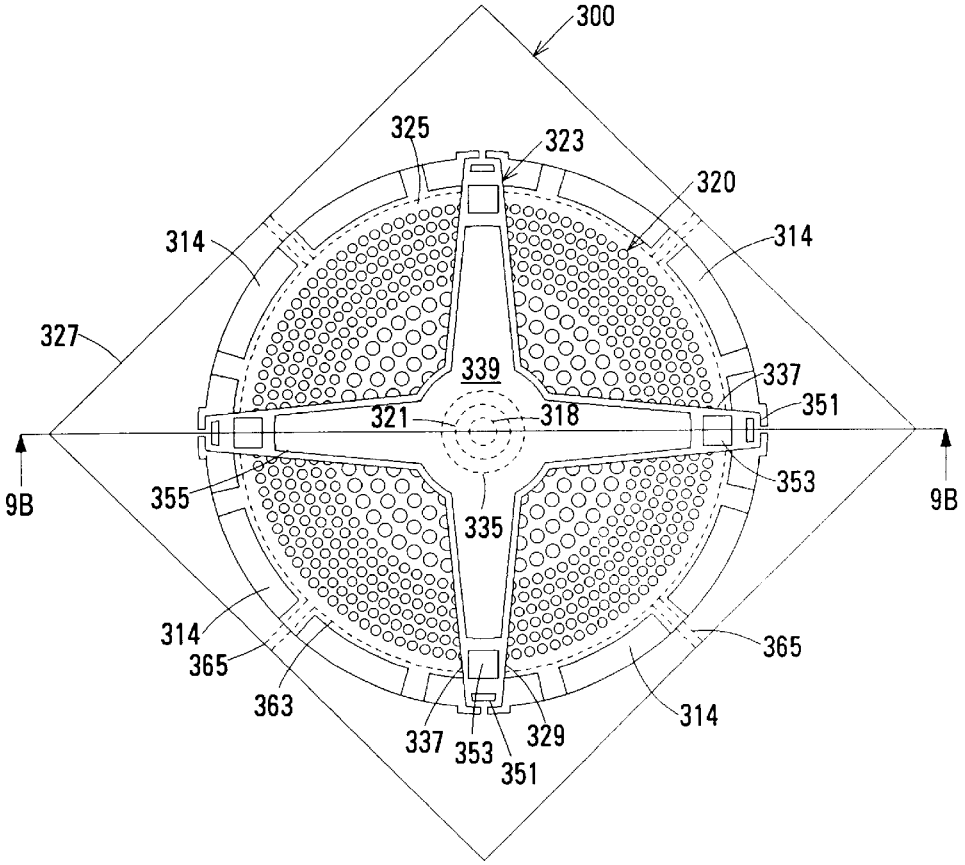
FIGS. 9A, 9B and 9C are a plan view and two cross-sectional views of a third variation of the embodiment of the pressure regulator according to the invention shown in FIGS. 1A–1C. In this variation, the ink delivery channel extends radially from the ink inlet to the ink outlet, and the capillary array is substantially co-extensive with the ink delivery channel.
Figure 9B:
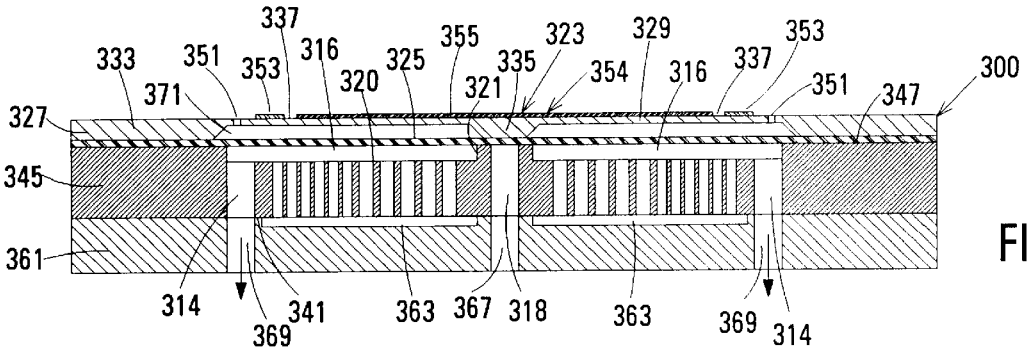
Figure 9C:
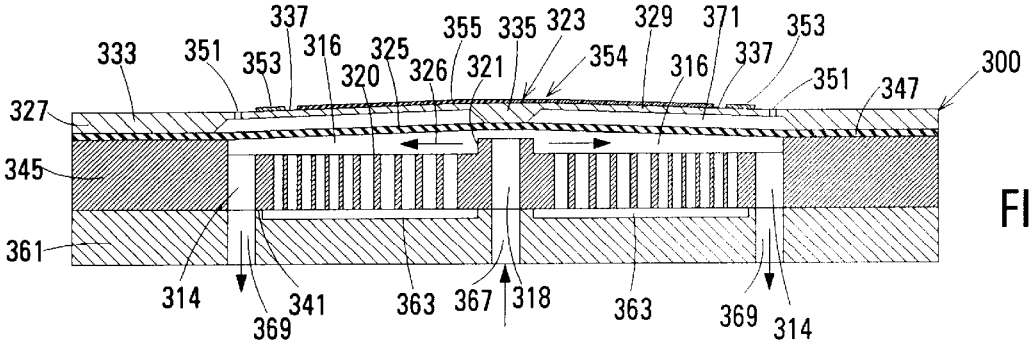

The embodiments described above employ an elongate ink delivery channel. However, the ink delivery channel may alternatively be radial, as in the embodiment 300 of a pressure regulator according to the invention shown in FIGS. 9A–9C. A radial ink delivery channel enables a chip of a given size to accommodate a large capillary array, promotes easy integration of the capillary array with a relatively large valve and enables the ink outlet to be located conveniently for feeding an edge-fed print head.

In the pressure regulator 300, the ink inlet 318 is located substantially in the center of the substrate 345 and extends through the thickness of the substrate. The ink outlet 314 is a segmented annular slot, coaxial with the ink inlet, that also extends though the thickness of the substrate. The radial ink delivery channel 316 is an annular recess extending into the substrate from the surface 347 of the substrate. The ink delivery channel extends radially outwards from the ink inlet to the ink outlet. The capillary array 320 is composed of capillaries that extend through the thickness of the substrate from the bottom of the ink delivery channel to the major surface 341 of the substrate and is substantially co-extensive with the ink delivery channel.

The capillaries constituting the capillary array 320, or a subset of them, may be fitted with electrodes (not shown) similar to those shown in FIGS. 5E and 5F. The electrodes are electrically connected to a control circuit (not shown). The control circuit determines the fraction of the capillary array that is filled with ink in response to signals generated by the electrodes and, in response to this determination, controls the valve 354. The valve 354 controls the flow of ink through the ink inlet 318 to the ink delivery channel. Other types of sensors that detect the fraction of the capillary array that is filed with ink or detect the ink pressure in the ink delivery channel 316 may alternatively be used to control the valve. Examples of such sensors are described above with reference to FIGS. 5A–5D and 5G–5I.

The valve 354 is based on the thermally-actuated microminiature valve disclosed by Gordon et al. in U.S. Pat. No. 5,058,856, assigned to the assignee of this invention. The disclosure of patent no. 5,058,856 is incorporated herein by reference. The substrate 345 is shaped to include the seat 321. The seat is a portion of the substrate that surrounds the ink inlet and projects above the ink delivery channel 316. The valve additionally includes the actuator 323 and the diaphragm 325.

The diaphragm 325 bounds the ink delivery channel 316 and thermally isolates the actuator 323 from the ink (not shown) flowing through the ink delivery channel. Thermal isolation prevents the ink flow from cooling the actuator, which reduces the amount of energy required to open the valve. The diaphragm 325 is a substantially square or circular piece of a compliant material such as silicone rubber, polyimide or parylene attached at its center to the actuator 323 and sandwiched at its outer periphery between the substrate 345 in which the ink delivery channel 316 is formed and the actuator substrate 327 in which the actuator is formed.

The actuator 323 preferably includes a bimorph that bends in response to heat. A conventional bimetallic bimorph may be used. In the preferred embodiment, the bimorph is composed of the cladding layer 355 and the silicon spider 329. The actuator is shaped so that the bending that occurs when the silicon/nickel bimorph is heated moves the center of the actuator in a direction perpendicular to the plane of the actuator. Such motion opens the valve 354. Alternatively, the actuator may be composed of a piezoelectric element mounted at the center of a spider of silicon or some other suitable material.

In the example shown, the spider 329 is formed by performing micro-machining operations on the actuator substrate 327. The actuator substrate is preferably single-crystal silicon. The actuator substrate is selectively etched to define the annular cavity 371 that extends between the attachment portion 333 and the boss 335. The boss is located at the center of the actuator substrate 327 so that it will be juxtaposed with the seat 321 when the actuator substrate is attached to the substrate 345. Then, the part of the actuator substrate that bounds the annular cavity 371 is selectively etched through to define the spider 329 and the compliant suspension members 351 extending between the spider and the attachment portion.

In the example shown, the spider 329 has a cruciform shape and is composed of the four legs 337 radiating outwards from the central portion 339. The compliant suspension members 351 couple the ends of the legs remote from the central portion to the attachment portion 333 of the actuator substrate 327. The compliant suspension members are compliant both translationally, in the radial direction of the spider, and rotationally. Translationally, the compliant suspension members accommodate the tendency of the ends of the legs to move radially inwards as the legs bend in response to being heated. Rotationally, the compliant suspension members accommodate the rotational movement that occurs as the legs expand and bend in response to being heated. Finally, the compliant suspension members thermally isolate the legs from the attachment portion to reduce the energy required to open the valve. The actuator may have a different shape and a different number of legs from the example shown.

A seed layer of metal such as nickel is deposited on the spider 329 by sputtering, for example. An adhesion layer may be deposited before the seed layer is deposited. Parts of the seed layer are selectively removed by etching, for example, to define a heater 353 on each of the legs 337, and the location of the cladding layer 355. The heaters are shown schematically to simplify the drawing. Removing parts of the seed layer may additionally define conductors (not shown) that supply electrical energy to the heaters. The portion of the seed layer defining the location of the cladding layer is then electroplated with a thick layer of a metal such as nickel to complete the formation of the cladding layer 355.

The spider 329 is preferably stressed during formation of the cladding layer 355 to give the actuator 323 a slightly concave shape at room temperature. Attaching the attachment portion 333 of the actuator substrate 327 to the substrate 345 and the diaphragm 325 bends the actuator so that the actuator assumes the substantially flat shape shown in FIG. 9B. The stress resulting from bending the actuator causes the boss 335 to hold the center of the diaphragm 325 in contact with the seat 321. Contact between the seat and the compliant material of the diaphragm forms a seal that closes the valve 354. This prevents ink from entering the pressure regulator 300 even when no power is applied to the valve. This occurs when the printer in which the pressure regulator 300 is located is switched off, for example.

The force holding the valve 354 closed when no power is applied to the valve can be increased by increasing the thickness of the boss 335. This may be done by depositing a layer of metal on the surface of the boss facing the seat 321. The process described above for forming the cladding layer 355 may be used to deposit such a metal layer on the boss.

The pressure regulator 300 is shown attached to the input/output substrate 361. Formed in the input-output substrate are the annular plenum 363 and radial passages 365 that connect the plenum to the edge of the input/output substrate. The plenum and the radial passages provide pressure communication between the atmosphere (or other source of a reference pressure) and the ends of the capillaries of the capillary array 320 remote from the ink delivery channel 316. Also formed in the input/output chip are the ink input passage 367 and the ink output passage 369. Ink flows through the ink input passage 367 to the ink inlet 318 and flows from the ink outlet through the ink output passage 369 to the print head (not shown).

As noted above, the valve 354 is normally closed. When the control circuit (not shown) determines that the capillary array 320 is nearly empty or that the pressure in the ink delivery channel 316 is near the minimum of its allowed range, the control circuit feeds a current to the heaters 353 located on each of the legs 337 of the actuator 323. Heat generated by the heaters heats the legs. The difference in the coefficients of thermal expansion between the silicon of the spider 329 and the nickel of the bending layer 355 causes the legs 337 of the spider 329 to bend. As a result, the actuator assumes the convex shape shown in FIG. 9C. In assuming its convex shape, the actuator operates via the boss 335 to pull the center of the diaphragm 325 away from the valve seat 321. This opens the valve 354 so that ink can enter the pressure regulator 300 through the ink inlet 318. Ink flows through the ink delivery channel 316 in the directions shown by the arrows 326 to replenish the ink supply stored in the capillary array and also flows to the ink outlet 314.

The valve 354 remains open until the control circuit (not shown) determines that the capillary array 320 is nearly full or that the pressure in the ink delivery channel 316 is near the maximum of its allowed range. In response to this determination, the control circuit stops the flow of current to the heaters 353. This causes the temperature of the actuator 323 to fall, and the actuator returns to its substantially flat shape shown in FIG. 9B. This closes the valve 354. The above-described cycle repeats to allow the valve 354 to control the ink flow through the ink delivery channel 316 to a rate that enables the capillary array to regulate the ink pressure in the ink delivery channel.

In the embodiment just described, the ink delivery channel 316 is formed by etching an annular cavity extending into the substrate 345 from the surface 347. Fabrication of the pressure regulator 300 may be simplified by using the surface 347 of the substrate 345 as the bottom of the ink delivery channel. This obviates the need to etch an annular cavity in the substrate 345 and simplifies the task of forming electrodes surrounding the ends of the capillaries of the capillary array 320. Alternatively, a shallow annular cavity may be etched into the substrate 345 to serve as part of the ink delivery channel.

When no annular cavity is etched in the substrate 345 to accommodate the ink delivery channel 316, or only a shallow annular cavity is etched, the annular cavity 371 formed when the attachment portion 333 and the boss 335 are defined in the actuator substrate 327 provides all or part of the ink delivery channel. In such an embodiment, the diaphragm 325 is attached to the undersides of the legs 337 and follows the contours of the attachment portion 333 and the boss 335 formed in the actuator substrate. In addition, the surface of the diaphragm remote from the ink delivery channel may be substantially co-planar with the surface of the legs remote from the ink delivery channel.

Although the invention has been described in terms of regulating the pressure at which ink is delivered to the ink inlet of the print head of an ink-jet printer, the invention can be applied to regulating the pressure of other fluids in other applications. In particular, the invention can be applied to structures similar to those described above in which the firing of a firing element located in a chamber fitted with a small orifice causes a liquid other than ink to be ejected from the orifice and in which regulation of the pressure at which the liquid is delivered to the chamber is required.

Although this disclosure describes illustrative embodiments of the invention in detail, it is to be understood that the invention is not limited to the precise embodiments described, and that various modifications may be practiced within the scope of the invention defined by the appended claims.

We claim:

1. A pressure regulator for setting the pressure of a liquid to a predetermined pressure differential below a reference pressure, the liquid having a surface tension, the pressure regulator comprising:

a liquid inlet;

a liquid outlet;

a liquid delivery channel through which the liquid flows from the liquid inlet to the liquid outlet; and a capillary array composed of substantially similar ones of an elongate capillary, the capillary being bounded by a wall, having a length and having cross-sectional dimensions in a plane substantially perpendicular to the length, the capillary including:

in fluid communication with the liquid delivery channel, a first end through which the liquid flows into the capillary to form a liquid surface therein, and in pressure communication with the reference pressure, a second end remote from the first end, the cross-sectional dimensions of the capillary, the surface tension of the liquid in the capillary and a contact angle between the liquid and the wall of the capillary collectively establishing a pressure drop across the liquid surface in the capillary that defines the predetermined pressure differential below the reference pressure.

2. The pressure regulator of claim 1, additionally comprising a flow restrictor located in the liquid delivery channel upstream of the capillary array.

3. The pressure regulator of claim 2, in which the flow restrictor comprises a narrowing of the liquid delivery channel.

4. The pressure regulator of claim 2, in which the flow restrictor comprises a valve.

5. The pressure regulator of claim 4, additionally comprising a sensor coupled to control the valve.

6. The pressure regulator of claim 5, in which the sensor comprises a pressure sensor located in the liquid delivery channel.

7. The pressure regulator of claim 6, in which the pressure sensor includes:

an array of pressure sensor capillaries, the array of pressure sensor capillaries including capillaries having different widths; and electrodes associated with the array of pressure sensor capillaries.

8. The pressure regulator of claim 6, in which the pressure sensor includes:

a flared pressure sensor capillary; and electrode means for determining an ink level in the flared pressure sensor capillary.

9. The pressure regulator of claim 5, in which the sensor detects one of (a) a presence and (b) an absence of the liquid in at least part of the capillary array.

10. The pressure regulator of claim 5, in which the sensor detects one of (a) a presence and (b) an absence of the liquid in part of the liquid delivery channel.

11. The pressure regulator of claim 10, in which the capillary array includes capillaries of different widths.

12. The pressure regulator of claim 5, in which:

the capillary array includes:

first capillaries having dimensions substantially equal to average dimensions, and a second capillary having dimensions one of greater than and less than the average dimensions; and the sensor detects at least one of (a) a presence and (b) an absence of the liquid in at least the second capillary.

13. The pressure regulator of claim 5, in which:

the pressure regulator additionally comprises a substrate having opposed major surfaces;

the capillaries constituting the capillary array extend through the thickness of the substrate from one of the major surfaces to the other; and the pressure sensor additionally includes electrodes located on both of the major surfaces of the substrate, adjacent the capillary array.

14. The pressure regulator of claim 4, in which:

the capillary array is a first capillary array composed of ones of an elongate first capillary;

the valve is a first valve; and the pressure regulator additionally comprises:

a second capillary array composed of ones of an elongate second capillary, the second capillary being bounded by a wall, having a length and having second cross-sectional dimensions in a plane substantially perpendicular to the length, the second capillary including:

in fluid communication with the liquid delivery channel between the first valve and the first capillary array, a first end through which the liquid flows into the capillary to form a liquid surface therein; and in pressure communication with the reference pressure, a second end remote from the first end, the cross-sectional dimensions of the second capillary, the surface tension of the liquid in the second capillary and an angle of contact between the liquid and the wall of the second capillary collectively establishing a pressure drop across the liquid surface in the second capillary less than the predetermined pressure differential, and a second valve located in the liquid delivery channel between the second capillary array and the first capillary array.

15. The pressure regulator of claim 4, in which:

the liquid delivery channel is a first liquid delivery channel;

the capillary array is a first capillary array the valve is a first valve; and the pressure regulator additionally comprises:

a second liquid delivery channel through which the liquid flows from the liquid inlet to the liquid outlet, a second capillary array in fluid communication with the second liquid delivery channel, the second capillary array being similar to the first capillary array, a second valve in the second liquid delivery channel between the second capillary array and the liquid inlet.

16. The pressure regulator of claim 15, additionally comprising:

a third valve in the first liquid delivery channel between the first capillary array and the liquid outlet; and a fourth valve in the second liquid delivery channel between the second capillary array and the liquid outlet.

17. The pressure regulator of claim 15, additionally comprising a control circuit that drives the first and fourth valves in antiphase with the second and third valves.

18. The pressure regulator of claim 1, in which:

the pressure regulator additionally comprises:

a substrate;

a barrier layer in which the liquid delivery channel is formed, the barrier layer being supported by the substrate; and the capillary array is located in one of the barrier layer and the substrate.

19. The pressure regulator of claim 18, in which the substrate comprises a material selected from a group consisting of silicon, quartz, glass and plastic.

20. The pressure regulator of claim 18, in which:

the barrier layer has trenches formed therein, the trenches extending lengthways through the barrier layer from the liquid delivery channel to a surface remote from the liquid delivery channel, and extending depthwise through the barrier layer to the substrate; and the pressure regulator additionally comprises a planar cover plate attached to the barrier layer, a first part of the cover plate covering the trenches to form the capillaries constituting the capillary array, a second part of the cover plate bounding the liquid delivery channel.

21. The pressure regulator of claim 18, in which:

the barrier layer is a first barrier layer;

the pressure regulator additionally comprises a second barrier layer located on the first barrier layer;

the second barrier layer has trenches formed therein, the trenches extending lengthways through the second barrier layer from the liquid delivery channel to a surface remote from the liquid delivery channel, and extending depthwise through the second barrier layer to first barrier layer; and the pressure regulator additionally comprises a planar cover plate attached to second barrier layer, a first part of the cover plate covering the trenches to form the capillaries constituting the capillary array, a second part of the cover plate covering the liquid delivery channel.

22. The pressure regulator of claim 18, in which:

the pressure regulator additionally comprises a planar cover plate attached to the barrier layer, part of the cover plate covering the liquid delivery channel; and the capillaries constituting the capillary array extend lengthways through one of (a) the substrate and (b) the cover plate from the liquid delivery channel to a major surface of the one of (a) the substrate and (b) the cover plate, respectively, remote from the barrier layer.

23. The pressure regulator of claim 22, in which:

the barrier layer additionally has trenches formed therein, the trenches extending lengthways through the barrier layer from the liquid delivery channel to a surface remote from the liquid delivery channel, and extending depthwise through the barrier layer to the substrate; and part of the cover plate covers the trenches to form capillaries constituting a second capillary array.

24. The pressure regulator of claim 18, in which:

the substrate has a first major surface on which the barrier layer is located;

the barrier layer has trenches formed therein, the trenches extending lengthways through the barrier layer from the liquid delivery channel to a surface remote from the liquid delivery channel, and extending depthwise through the barrier layer to the substrate, the trenches including walls substantially orthogonal to the first major surface; and the pressure regulator additionally includes a fillet extending between each of the walls of the trenches and the first major surface.

25. The pressure regulator of claim 1, additionally comprising a temperature control element adjacent the capillary array.

26. The pressure regulator of claim 1, additionally comprising a cross path connecting a point closer to the first end than the second end of the capillary to another of the ones of the elongate capillary.

27. The pressure regulator of claim 1, additionally comprising:

a substrate having a thickness through which the capillary array extends; and electrodes located on the substrate on opposite sides of the capillary.

28. The pressure regulator of claim 27, in which:

the capillary array includes first capillaries having cross-sectional dimensions substantially equal to average dimensions;

the capillary has cross-sectional dimensions one of (a) greater than and (b) less than the average dimensions; and the electrodes are located on the substrate on opposite sides of one of the first capillaries.

29. The pressure regulator of claim 1, in which:

the ink delivery channel extends radially outwards from the ink inlet to the ink outlet; and the capillary array is substantially co-extensive with the ink delivery channel.

30. The pressure regulator of claim 29, additionally comprising an electrically-operated valve that selectively opens and closes the ink inlet.

31. The pressure regulator of claim 30, in which the electrically-operated valve includes:

a thermally-deformable actuator centered on the ink inlet;

a diaphragm arranged to seal the ink delivery channel, the diaphragm including a portion located between the ink delivery channel and the actuator; and means for changing temperature of the thermally-deformable actuator.

* * * * *